US011299827B2

(12) United States Patent
Tolle

(10) Patent No.: US 11,299,827 B2
(45) Date of Patent: Apr. 12, 2022

(54) NANOCONDUCTOR SMART WEARABLE TECHNOLOGY AND ELECTRONICS

(71) Applicant: James Tolle, Manassas, VA (US)

(72) Inventor: James Tolle, Manassas, VA (US)

( * ) Notice: Subject to any disclaimer, the term of this patent is extended or adjusted under 35 U.S.C. 154(b) by 285 days.

(21) Appl. No.: 16/403,541

(22) Filed: May 4, 2019

(65) Prior Publication Data

US 2019/0355491 A1 Nov. 21, 2019

Related U.S. Application Data

(60) Provisional application No. 62/673,099, filed on May 17, 2018.

(51) Int. Cl.

| | |
|---|---|
| ***H01B 5/00*** | (2006.01) |
| ***D03D 49/24*** | (2006.01) |
| ***D03D 47/34*** | (2006.01) |
| ***D03D 47/12*** | (2006.01) |
| ***D03J 1/00*** | (2006.01) |
| ***D03D 47/27*** | (2006.01) |
| ***D01F 1/09*** | (2006.01) |
| ***D03D 1/00*** | (2006.01) |
| ***H01B 5/14*** | (2006.01) |
| ***H01B 13/00*** | (2006.01) |

(52) U.S. Cl.

CPC ..... *D03D 49/24* (2013.01); *D01F 1/09* (2013.01); *D03D 1/0088* (2013.01); *D03D 47/125* (2013.01); *D03D 47/271* (2013.01); *D03D 47/34* (2013.01); *D03J 1/007* (2013.01); *H01B 5/14* (2013.01); *H01B 13/0026* (2013.01); *D03J 2700/06* (2013.01)

(58) Field of Classification Search

CPC ..... D03D 1/0088; H01B 5/14

See application file for complete search history.

(56) References Cited

U.S. PATENT DOCUMENTS

| | | | |
|---|---|---|---|
| 6,381,482 | B1 | 4/2002 | Jayaraman |
| 6,942,496 | B2 | 9/2005 | Sweetland |
| 7,425,501 | B2 | 9/2008 | Nugent |
| 7,426,501 | B2 | 9/2008 | Nugent |

(Continued)

OTHER PUBLICATIONS

Seongpil, et al., "Self-Junctioned Copper Nanofiber Transparent Flexible Conducting File via Electrospinning and Electroplating", Advanced Materials, Sep. 7, 2016, pp. 7149-7154, vol. 28, Issue 33, Wiley Online Library https://onlinelibrary.wiley.com/toc/15214095/2016/28/33.

*Primary Examiner* — Andrew T Piziali

(57) ABSTRACT

A wearable, nanoconductor technology for smart electronic applications. A novel nano-scale geometry is achieved for nanoconductor circuits on the order of the size of a single thread or smaller, which are easily integrated with clothing and provide smart applications for wearable electronics. The nano-scale fibers provide improved material characteristics and the fixed geometry and orientation of the nanoconductor structures allow easier interface of nanoconductor electronics integrated with the clothing or with electronics external to the weave of the clothing. Novel electronic circuits based on the size and fixed geometries of the nanoconductor fibers which allow configurable functions that can be employed for different uses through logic circuit configuration or serial programming during wear are disclosed.

33 Claims, 27 Drawing Sheets

(56) References Cited

U.S. PATENT DOCUMENTS

| | | | | |
|---|---|---|---|---|
| 8,108,157 | B2 | 1/2012 | Chase | |
| 8,536,075 | B2 * | 9/2013 | Leonard | G06K 19/027 442/301 |
| 9,974,170 | B1 | 5/2018 | Sunshine | |
| 10,174,444 | B1 * | 1/2019 | Podhajny | D03D 15/00 |
| 10,244,625 | B2 | 3/2019 | Sunshine | |
| 2004/0009729 | A1 * | 1/2004 | Hill | D03D 15/258 442/208 |
| 2007/0178716 | A1 | 8/2007 | Glaser | |
| 2007/0218281 | A1 * | 9/2007 | Demir | D06M 11/83 428/389 |
| 2015/0370320 | A1 | 12/2015 | Connor | |
| 2019/0327832 | A1 * | 10/2019 | Holbery | H01B 7/292 |

* cited by examiner

NANOCONDUCTOR SMART WEARABLE TECHNOLOGY AND ELECTRONICS

CROSS-REFERENCES TO RELATED APPLICATIONS

This application claims the benefit of priority of the provisional patent application No. 62/673,099, "Nanoconductor smart wearable technology and electronics".

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The following notice applies to all documentation described below and to all drawings accompanying and made part of this document: © 2017-2019 James Tolle.

BACKGROUND OF THE INVENTION

Field of the Invention

The field of the invention is wearable technology and electronics. Wearable technology varies in size from larger devices which are designed to be carried on or with the body down to devices or circuits which approach the size of the threads of the clothing. In current usage, a "thread" usually refers to a textile yarn which is composed of one or more "fibers". The cross-section size of the thread varies depending on the size and number of fibers making up the thread, covering a range of hundreds to thousands of microns. Advances of wearable technology tend toward smaller devices and technology which can be more integrated with the body or an article of clothing. This invention is intended to achieve better integration of devices and electronic circuits with the garment by achieving a nanoconductor structure which is substantially smaller than the size of the threads. The cross-section of the common textile thread used throughout the description of the current invention is based on a mono-filament fiber of at least 150 microns. "Thread-sized" used in the description of the invention is intended to mean this size of 150 microns or larger. The current invention achieves nanoconductor fibers on the scale of thread-sized fiber so that the nanoconductors and circuits based on them can be fully integrated in the weave of the fabric. The invention scales according to the application from local portions of clothing up to a complete article of clothing. Throughout the description of the current invention, the term "article of clothing" is intended to cover all wearable applications of the invention, including those covering only a localized portion of clothing as well as applications which cover a full article of clothing. An "article of clothing" is also intended to cover any clothing or other fabric comprising the invention, whether or not such clothing or fabric is currently assembled into something that can be worn by a person or intended to be worn by a person. Where "garment" is used, it is intended to be inter-changeable with an "article of clothing".

The present invention discloses nanoconductor electronics and technology which is more fully integrated with textiles for garments of clothing or other applications. For wearable electronics to be fully integrated with the weave of a cloth or garment, the components have to approach nano-scale geometries. Limitations of previous wearable conductors arise because they are based on metallic threads or textile fibers that are coated or impregnated with conductive material, all of which fail to achieve dimensions smaller than the weave of the textile. In order to achieve a nano-scale conductor which can integrate within the weave of the clothing, typical electrospinning techniques are used to create a metalized nanoconductor matrix to start the fabrication of the invention.

Description of Related Art

The following discussion of past wearable technology and electronics in the prior art explains how these approaches do not adequately cover all the novel aspects of the current invention nor disclose an obvious means of addressing the making or usage of the current invention by someone skilled in the art.

Devices Based on Non-Integrated Electronics

Much prior art involves the addition of discrete or other non-integrated electronics to clothing or wearable accessories. The failure of this art to disclose technologies at scales similar to the present invention at the nanoconductor level prevent these inventions from being as fully integrated with clothing and textiles as the current invention. The difficulty that the prior art has in achieving the same level of advanced integration and usefulness of the current invention when such art is based on discrete electronic components well above the nanoconductor scale is exemplified in U.S. Pat. No. 8,536,075, Leonard. The art in Leonard is instructive for the prior art based on larger-scale technologies because the claims in Leonard are based on electronic devices and circuits which are substantially larger than the textile comprising the clothing and are not easily integrated with the clothing due to size and the need for proper alignment of the electrical components in Leonard in order to keep the externally attached circuits from separating from the garment. The class of art represented by Leonard demonstrates how the current invention advances state-of-the-art with a novel nanoscale geometry which achieves full-integration of the wearable technology and electronics at the textile level. Unlike Leonard, the current invention uses novel nanoconductor-based fibers which take the place of the thread within a garment and achieve full integration of the smart technology provided by this invention with the weave of the clothing. Leonard and the other prior art in this class which uses larger, traditional electronics and circuits also fail to disclose the smart technology aspects of the current invention, which are based on and only possible due to the nanoconductor-scale integration achieved by this invention.

U.S. Pat. No. 8,536,075, Leonard (Electronic systems incorporated into textile threads or fibres)

Wearable Contacts and Fastener Technologies

Other examples of discrete electrical components embedded in clothing include the prior art which discloses electrical contacts or fasteners. Such example is U.S. Pat. No. 6,942,946, Sweetland, et al. Sweetland, et al. discloses a discrete conductor wire woven within a garment in such a way to allow electrical contact with another conductor of the same garment when the associated connector is closed. Sweetland, et al. and other similar prior art fails to disclose wearable technology, conductors and circuits which are at the nano-scale geometries such as the current invention. Because of the difference between the discrete conductors and components used by Sweetland, et al. and the novel size and geometry of the current invention, the prior art based on discrete conductors and components cannot achieve the electronic circuits which are integrated within the weave of the garment like the nano-scale conductors and components of the current invention. The current invention includes electrical connectors which allow macro-scale circuits to be connected to the nano-scale circuits of the invention, but these are novel connectors which are only possible due to the unique geometry achieved by the current invention. For these reasons, all of the connector, contact and fastener prior art for wearable technology like Sweetland, et al. fail to disclose the novel nano-scale conductor and contact technology of the current invention.

U.S. Pat. No. 6,942,496, Sweetland, et al. (Woven multiple-contact connector), U. S. Patent Application 2007/0178716 A1, Glaser, et al. (Modular microelectronic-system for use in wearable electronics)

Conducting Fibers and Mesh Based Technology

More recent art disclose fabric and textiles based on conducting fibers, both metallic and semi-conductive. Although this art covers technology which may be more integrated with the weave of the clothing, none of it approaches the full integration provided by the nanoconductor scale of the wearable technology in the current invention. An example is U.S. Pat. No. 6,381,482, Jayaraman, et. al, which claims a fabric using "conducting polymers, doped fibers, and metallic fibers" integrated with the garment. These conducting materials can be integrated more than the discrete component circuits as in Leonard, but the scale of the integration in Jayaraman, "225 to 255 microns" is order of magnitudes greater than the nanometer-scale achievable with the current invention's novel technology. The class of art which uses conductive threads or other technology not based on nanoconductors cannot achieve the integrated, smart technology of the current invention.

U.S. Pat. No. 6,381,482, Jayaraman, et al. (Fabric or garment with integrated flexible information infrastructure)

Nanoconductor Based Circuits and Applications

Other examples of prior art disclose different nano-technologies which approach the scale of the current invention. However, all of this art fails to disclose all of the novel advances in nanoconductor-based wearable technology as in the current invention. Furthermore, the current invention is based on research which shows that most nanoconductor technology would fail to achieve the current invention because of limitations due to size, geometry, material and process, all of which are novel aspects of the current invention which make it possible.

U.S. Pat. No. 7,426,501, Nugent, discloses nanoconductors based on carbon and other non-metallic materials suspended in solution as part of neural networks. This art is an example of the class of prior art which is based on non-metallic nanoconductors. However, nanoconductors of the type disclosed in this art and listed in Nugent will fail to achieve the size, material characteristics, and geometry of the current invention's nanoconductors.

The current invention requires nanoconductors which perform at a sub-micron scale. The current invention uses silver nanoconductors based on Polyacrylonitrile (PAN), which has recently been shown to achieve the scales and material properties required by the current invention. By using these novel nanoconductors, a nanoconductor strip can be bonded to a polyester fiber, such as Polyethylene Terephthalate (PET), and provide a very strong, high conductance electronic circuit. The novel material properties, performance and smart technology which is possible in the current invention distinguishes the current invention from Nugent and all other prior art which is based on carbon or other nanoconductors not using the current invention's materials.

Other art involves metallic nanoconductor materials. However, in all of these cases, one must be careful to note the difference in the material properties, scales, process and geometry which prevent each of these to fail to achieve the novel application of the current invention. In the case of U.S. patent application Ser. No. 14/736,652, Connor, a "energy pathway" based on "copper . . . gold; nickel . . . silver; and steel" is disclosed. Even though Connor lists silver in its specification, the art does not actually disclose a silver-based nanoconductor like the current invention. Furthermore, the process described by Connor for making these "energy pathways" is limited to "coating or impregnating" these materials. Connor fails to disclose with sufficient detail how this conducing material will be made through the "coating and impregnating" process, but it is clear that if it approaches the scale of the fibers of the garment, it will still be at a much larger scale than the current invention. Connor also mentions carbon nanotubes in this part of the art, but even if the "coating and impregnating" is done at the carbon nanotube size, the process itself fails to achieve the novel aspects of the process used in the current invention. The novel geometry of the current invention is based on the nanoconductor being significantly smaller than the cross-section of the textile fibers. The "coating and impregnation" processes described by Connor cannot approach this scale or support this novel geometry. This prevents Connor and all art like it from being able to come close to the performance and smart applications which the current invention supports. For these reasons, the prior art based on nanoconductors comprised of macro-fiber scale conducting materials or textile fibers coated or impregnated by conducting material fail to disclose nanoconductor-based technology or circuits of the size, scale or novel geometries which allow full integration with clothing as the current invention does.

A more recent example of nanoconductor technology applied to fiber sized applications is U.S. Pat. No. 9,974,170, Sunshine, et al. Sunshine's team at Apple discloses a broad list of materials that can be used with polymer fibers including metal, graphene and carbon nanotube material. Sunshine further discloses the use of conductive strands as signal paths associated with electrical components. Although at first reading, Sunshine may appear to be the same as the current invention, its prior art is substantially different than the nanoconductor fibers of the current invention in two ways. First, the fibers in Sunshine are enhanced for conductivity by the use of metallic coating or through a conductive filler based on metal, graphene, carbon nanotube, or other conductive filler. These methods for fabricating the conductive strands in Sunshine differ greatly from the novelty and nature of the electro-spinning based techniques used in the current invention. In the current invention, the electro-spinning techniques produce a continuous structure of nanoconductor material along the length of the fiber with improved properties of conductivity because of the uniform structure of the nanoconductor. In Sunshine's prior art, the filling process used to create conductive fibers relies on doping of the polymer material which does not produce as uniform or conductive of a surface as given by the nanoconductor strip of the current invention. A second substantive difference between Sunshine's prior art and the current invention is the scale of the conductive structures. Whereas in Sunshine, the invention achieves fiber sized conductive materials, it does not approach the novel nano-scale size of the conductive paths which is only possible in the current invention. The latter is an important difference with Sunshine because the size of Sunshine's conductive strands are not smaller than the fibers of a garment and does not support fixed orientation of the conductive surfaces within a garment like the current invention, nor insulating practices based on the novel arrangement of nano-scale fibers with fixed orientation to the threads, like the current invention. For these key reasons, the conductive polymers and signal paths produced by Sunshine fail to create prior art which affects the patentability of the current invention.

U.S. Pat. No. 7,426,501, Nugent (Nanotechnology neural network methods and systems); U. S. Patent Application 20150370320 A1, Connor (Smart Clothing with Human-to-Computer Textile Interface); U.S. Pat. No. 9,974,170, Sunshine et al. (Conductive strands for fabric-based items)

Electrospun Nanoconductors

Electrospun nanocostructures and electospinning methods are known in the prior art. An example of such is U.S. Pat. No. 8,108,157, Chase, et al., which discloses methods to produce electrospun polymer/nanoparticle composite-fiber structures for use as nano-scale sensors. Another example of electrospun metallic fibers is from "Self-Junctioned Copper Nanofiber Transparent Flexible Conducting File via Electrospinning and Electroplating", Seongpil, et al., Adv. Mater., 28:7149-7154. Seongpil, et al., discloses a method which provides copper-based nanofibers within a conducting film for improved electrical applications. These disclosures do not defeat the patentability of the current invention because the novelty of the current invention is not based on the electrospinning methods used for the nanoconductor component of the invention. The method used in the preferred and other embodiments of the current invention to enable the wearable, nano-scale technologies upon which the invention is based is similar, but the there are other parts of the current invention's methods which are novel compared to Seongpil. The prior art does not suggest nanoconductor fibers based on the electrospun stream with the same scale or fixed geometry of the current invention, which is achieved in the current invention by a novel steps involving masking, deposition and cutting that are not part of Seongpil's electroplate. The methods described to enable the current invention add a key masking or cutting steps to traditional electrospinning techniques from the prior art in order to achieve the nano-scale sizes that others, like Seongpil, do not obtain. Where prior art, as in Chase, purports to approach the nano-scale of the current invention, the prior art fails to suggest geometries at this scale like the current invention, where the nanoconducting strip runs along one side of the substrate fiber in a fixed geometry for the length of the substrate fiber, giving it novel characteristics and applications to circuits integrated with the cloth. Futhermore, the preferred embodiment of the current invention comprise steps which separate the electrospinning and metalization for reasons unique to this geometry of the current invention, unlike the prior art methods. For these reasons, the prior art involving electrospun and metalized nanoconductors fails to disclose art which defeats the novelty of the current invention and no combination of this prior art teaches someone skilled in the art how to achieve the same unique nano-scale technoloy as in the current invention.

U.S. Pat. No. 8,108,157, Chase, et al., (Electrospun fibrous nanocomposites as permeable, flexible strain sensors)

As can be seen by the preceding review of the prior art and the background of the current invention, no single example of art achieves all of the novel features of the current invention. Furthermore, no person skilled in the art would see an obvious combination of this art in order to cover what is disclosed in the current invention, there is no teaching, suggestion or motivation in the prior art to combine the references, and a resulting combination would not be understood to produce predictable results by someone with ordinary skill in the art. The current invention is a novel and not obvious invention which comprises the following features which are key for solving the need for smart wearable electronics:

wearable fully integrated within the fabric of the user's clothing or accessories integrated at the nanoconductor scale nanoconductors based on advanced materials similar to silver and PAN small enough scale to achieve a predictable geometry on common textile fibers similar to polyester fiber geometry supports uniform, bi-polar orientations nanoconductor separating geometry supports connections and complex circuits nano-scale components which allow configurable electronic circuits throughout the garment supports weaving of nanoconductors before configuration of wearable circuits novel nanoconductor geometry which supports simple, low-cost connections to larger discrete electronic components circuit programming supported by integrated, nanoconductor circuits

BRIEF SUMMARY OF THE INVENTION

The purpose of this invention is to introduce a novel wearable technology and electronics based on smart nanoconductor circuits which are more fully integrated with the textile comprising an article of clothing than any prior wearable technology. Previous nanoconductor technologies have suffered from size and geometry which limits the integration of the electronics that these wearable technology and nanocondutors support, often leading to a separate part of the clothing being used for the electronic circuit or mesh which is not part of the weave of the garment. Where the wearable technology is based on conductors running through lengths of the clothing, such technology still suffers from size and geometry which is not comparable or better than the textile fibers in which it is being integrated. The current invention intends to use novel nanoconductors which have unique geometries at the nano-scale, such size and geometry allowing the electronic circuits it supports to be fully integrated in the weave of the garment, much more integrated than any previous technology or nanoconductor. The current invention further provides for the creation of smart electronics based on the novel nano-scale technologies which are also more fully integrated with the clothing than any previous technology. The present invention achieves marked improvements in wearable technology and circuits which are only possible through novel advances in the fields of material science, electronics and wearable technology.

The present invention includes novel processing of the nanoconductor matrix to reduce the size of the invention to the scale smaller than the textile's fiber. In the preferred embodiment, the nanoconductor matrix material is deposited on a polyester fiber using a mask to reduce the size of the nanoconductor from approximately several centimeters to less than 500 nanometers. This step also fixes the geometry of the nanoconductor fiber structure so that it produces a uniform geometry with the conducting material on one side of the textile's cross section. The preferred embodiment follows the deposition step with metallization of the nanoconductor with silver to create the thermal and conducting properties of the present invention. The intention of this invention is to cover any and all means of fabricating the nanoconductor geometries of the invention using electrospinning methods or other similar filament-generating methods which produce a nanoconductor matrix made of filaments, such filaments having widths of 20 micrometers or less, including various electrospinning or similar filament-generating methods, deposition, and metalizing or carbonization steps, which are obvious from the preferred embodiment of the invention to anyone skilled in the art and all such methods are within the scope of the invention and are intended to be covered by its claims.

The present invention utilizes the novel geometry of its nano-scale geometry to support textile weaving of the nanoconductor into the weave of the garment or cloth. The invention's novel fabrication process allows a nanoconductor structure of any length along the fiber used. This supports the integration of the nanoconductor across the length of a garment or only within a region of the cloth. The intention of this invention is to cover all configuration and sizes of clothing or other fabrics integrated with the technology comprising the invention which are obvious to anyone skilled in the art and such configuration and sizes are within the scope of the invention and are covered by the its claims.

The present invention also discloses novel technology based on the uniform geometry of the nanoconductor structure which allows connection of the conducting surfaces of the textile with electrical contacts and wires to outside circuits. Furthermore, the nanoconductor structures also support the integration of electronic and semi-conducting components within the circuit of the wearable technology which allow the present invention to disclose applications of the wearable nanoconductor electronics as "smart" circuits or technologies which have features and properties that can be tailored to different user applications. The intention of this invention is to cover any and all types of electronic circuits, applications and technology based on the integration of the invention with an article of clothing which are obvious to a person skilled in the art and all such applications are within the scope of the invention and are covered by its claims.

In summary, what is patentable in this invention is described as follows, including all the key elements making it novel and separating it apart from what is found in the prior art. A wearable nanoconductor device comprised of an article of clothing with one or more fibers of substrate material secured to the clothing as an integral part of the clothing. A nanoconductor structure is secured along one or more of said fibers with a nano-scale width which is less than the cross-section size of a common textile thread, having a fixed geometry with respect to said fiber. The relation between the nanoconductor structure and the fiber defines different configurations of the invention, including a configuration in which the nanoconductor structure is restricted to one side or hemisphere of the fiber's cross-section; a configuration in which the nanoconductor structure runs on both sides (between both hemispheres) of the fiber's cross-section; or a configuration in which the fixed geometry of the nanoconductor structure allows an electrical connection to one side of a lead of an external circuit which is attached to the clothing.

An alternative embodiment includes a wearable nanoconductor device comprised of an article of clothing with one or more fibers of substrate material secured to the clothing as an integral part of the clothing. A nanoconductor structure is secured along at least one of the fiber substrates, such nanoconductor structure having a nano-scale width less than 600 nanometers. The nanoconductor structure is formed out of nano-scale polymer mats produced by means of electrospinning, where the nanoconductor structure is metalized with conductive material after the elctrospinning. The relation between the nanoconductor structure and the fiber defines different configurations of the invention, including a configuration in which the nanoconductor structure is restricted to one side or hemisphere of the fiber's cross-section; a configuration in which the nanoconductor structure runs on both sides (between both hemispheres) of the fiber's cross-section; or a configuration in which the fixed geometry of the nanoconductor structure allows an electrical connection to one side of a lead of an external circuit which is attached to the clothing.

Another embodiment is a wearable nanoconductor device comprised of an article of clothing, one or more fiber substrates secured to the clothing as an integral part of the article of clothing and a nanoconductor structure secured along each of the fiber substrates which are nanoconductor fibers, such structure having a nano-scale width less than 600 nanometers. This A circuit made up of the nanoconductor fibers is integral to this embodiment, such circuit comprising a circuit of one or more discrete electronic components and any number of connectors mating with the nanoconductor structure of the circuit's nanoconductor fibers using the fixed geometry of the nanoconductor structure and fiber. Such connectors allow connection between a power source, the nanoconductor fibers or circuit devices, or to allow connection between the circuit and external circuits, devices, or power sources. In this embodiment, the nanoconductor structure is formed out of nano-scale polymer mats produced by means of electrospinning and the nanoconductor structure is metalized with conductive material. The nanoconductor structure of this embodiment has a fixed geometry with the fiber. The relation between the nanoconductor structure and the fiber defines different configurations of the invention, including a configuration in which the nanoconductor structure is restricted to one side or hemisphere of the fiber's cross-section; a configuration in which the nanoconductor structure runs on both sides (between both hemispheres) of the fiber's cross-section; or a configuration in which the fixed geometry of the nanoconductor structure allows an electrical connection to one side of a lead of an external circuit, device or power source.

Yet another embodiment of the invention is a wearable nanoconductor device comprised of an article of clothing, one or more fiber substrates secured to the clothing as an integral part of the article of clothing and a nanoconductor structure secured along each of the fiber substrates which are nanoconductor fibers, such structure having a nano-scale width less than 600 nanometers. A circuit made up of the nanoconductor fibers is integral to this embodiment, such circuit comprising at least one of the following: a circuit of one or more logical components; a circuit of one or more configurable components; a circuit of one or more programmable components; and one or more connectors mating with the nanoconductor structure of the circuit's nanoconductor fibers using the fixed geometry of the nanoconductor structure and fiber (such connectors to allow connection between the power source, nanoconductor fibers or circuit devices, or to allow connection between the circuit and external circuits, devices, or power sources). The embodiment also comprises a power supply consisting of one or more of the following: one or more power sources integrated with the article of clothing; one or more connectors, such connectors connectable to an external power source. The nanoconductor structure of this embodiment has a fixed geometry with the fiber.

The relation between the nanoconductor structure and the fiber defines different configurations of the invention, including a configuration in which the nanoconductor structure is restricted to one side or hemisphere of the fiber's cross-section; a configuration in which the nanoconductor structure runs on both sides (between both hemispheres) of the fiber's cross-section; or a configuration in which the fixed geometry of the nanoconductor structure allows an electrical connection to one side of a lead of an external circuit, device or power source.

An additional embodiment of the invention which is a wearable nanoconductor device comprised of an article of clothing, one or more fiber substrates secured to the clothing as an integral part of the article of clothing and a nanoconductor structure secured along each of the fiber substrates which are nanoconductor fibers, such structure having a nano-scale width less than 600 nanometers. A circuit of said nanoconductor fibers is integral to this embodiment, such circuit made up of components or devices which are designed to function as smart components or devices comprising at least one of several types of smart components or devices. The list of smart components or devices comprising this emodiment includes one or more components or devices which can be configured prior to or at the time of donning to select or perform different functions. The list also includes one or more components or devices which can be configured during wear to select or perform different functions. Yet another type in the list of this embodiments smart components or devices is one or more components or devices which can be programmed prior to or at the time of donning to select or perform different functions. The list also includes one or more components or devices which can be programmed during wear to select or perform different functions; and one or more components or devices which can be configured or programmed by the circuit. This embodiment also comprises a power supply consisting of one or more of the following: one or more power sources integrated with the article of clothing; or one or more connectors mating with the nanoconductor structure of the circuit's nanoconductor fibers using the fixed geometry of the nanoconductor structure and fiber, such connectors connectable to an external power source.

The invention also discloses patentable methods which are not found in the prior art. One embodiment is a method for integrating a nanoconductor structure with a thread-sized fiber within an article of clothing to form nanoconductor wearable devices and circuits. This method includes the steps of electrospinning a polymer mat, attaching the polymer mat onto a polymer substrate using deposition with a mask of nano-scale width of 600 nanometers or less, metalizing the deposited nanoconductor polymer mat on the polymer substrate to form a nanoconductor fiber, and integrating the nanoconductor fiber with other fibers within the weave or stitch of an article of clothing. This method ensures that the nanodonductor structure on the nanoconductor fiber has a fixed orientation to the surface of the article of clothing.

An alternative embodiment is also a method for integrating a nanoconductor structure with a thread-sized fiber within an article of clothing to form nanoconductor wearable devices and circuits, but in this method, the steps comprise electrospinning a polymer mat, depositing the polymer mat onto a planar surface, metalizating the polymer mat to form the nanoconductor material, cutting the mat of the nanoconductor material to the nano-scale width of 600 nanometers or less, attaching the nanoconductor material on a fiber substrate using deposition to form a nanoconductor fiber, and integrating the nanoconductor fiber with other fibers within the weave or stitch of an article of clothing. This method also ensures that the nanodonductor structure on the nanoconductor fiber has a fixed orientation to the surface of the article of clothing.

BRIEF DESCRIPTION OF THE SEVERAL VIEWS OF THE DRAWING

The description of the current invention relies on the following drawings. These drawings are not to scale, contain only enough detail for descriptive purposes, and are intended to aid in understanding of the invention and the concepts and methods of how it is made and how it is used with the accompanying specification.

FIG. 7B shows the back view of the transfer device which conveys the nanoconductor fibers through the loom.

Figure 7A:
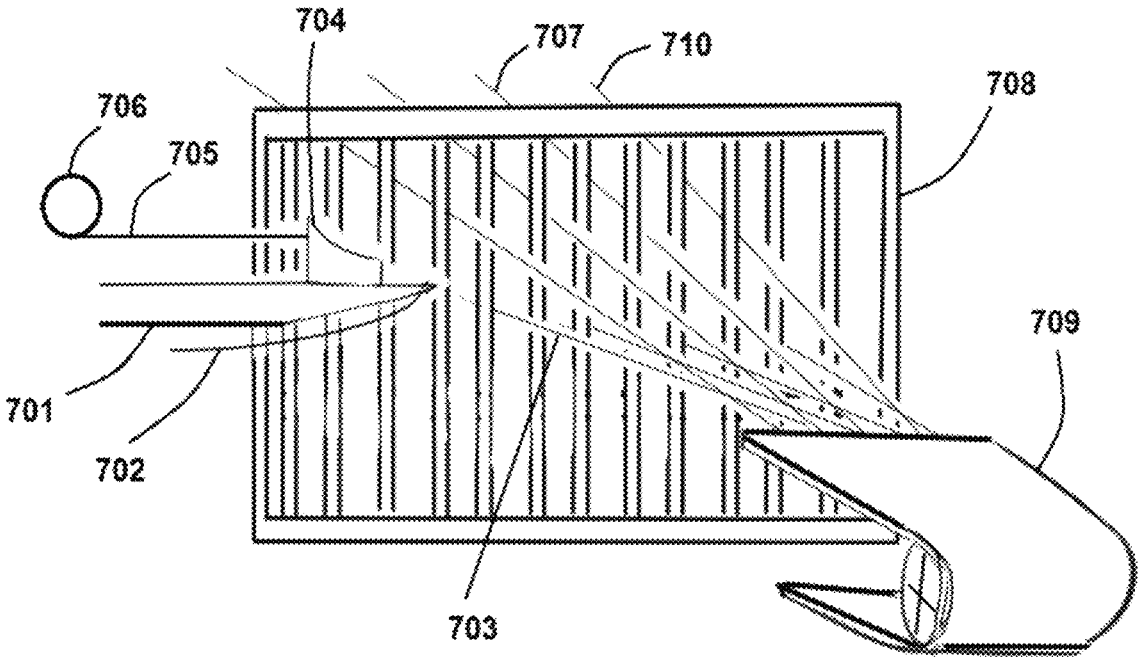
FIG. 7A through FIG. 7L are diagrams showing modified apparatus for weaving of the nanoconductor fibers in a fixed orientation within a textile, which can be described as follows. An example of a rapier loom concept which enables the invention is shown in FIG. 7A.
Figure 7B:
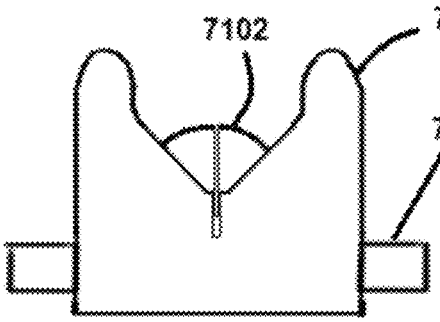
Figure 7C:
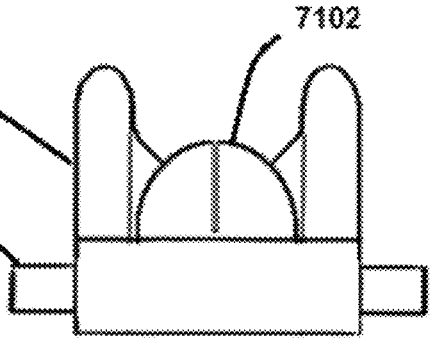

The front view of the transfer device is shown in FIG. 7C.

Figure 7D:
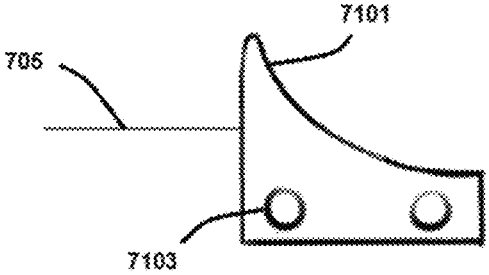

A side view of the transfer device is presented in FIG. 7D.

Figure 7E:
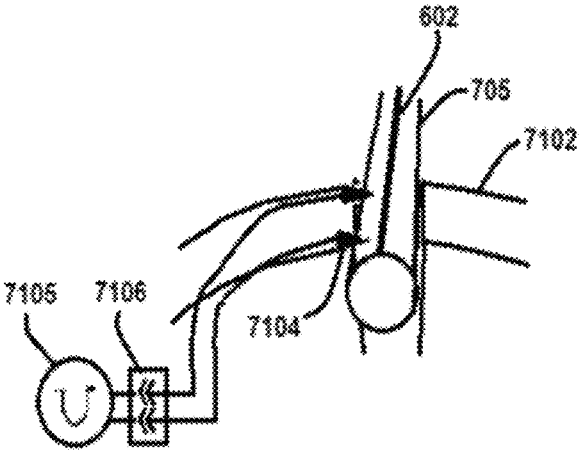

FIG. 7E provides a close-up view of the sensors and retaining disc which is carried by the transfer device.

Figure 7F:
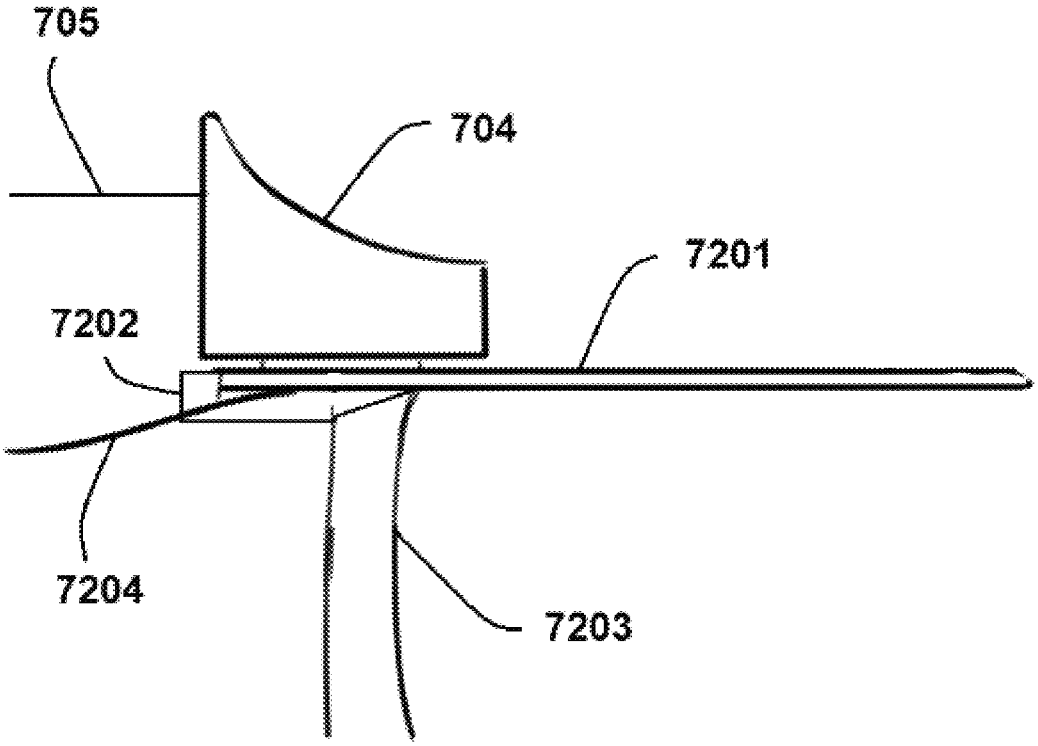

Alternative embodiments of the loom apparatus enabling the invention are given in FIG. 7F to FIG. 7L. FIG. 7F is an example of the transfer device as part of a projectile loom.

Figure 7G:
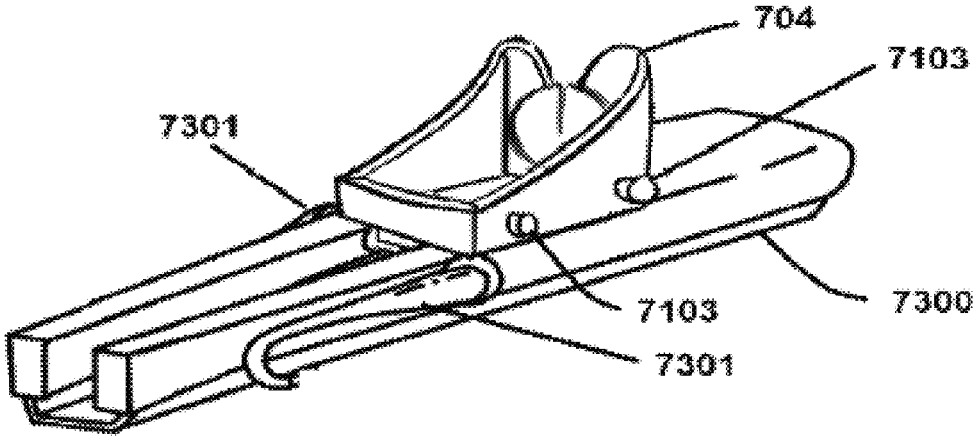

FIG. 7G shows one arm, the giver arm, of a dual rapier loom.

Figure 7H:
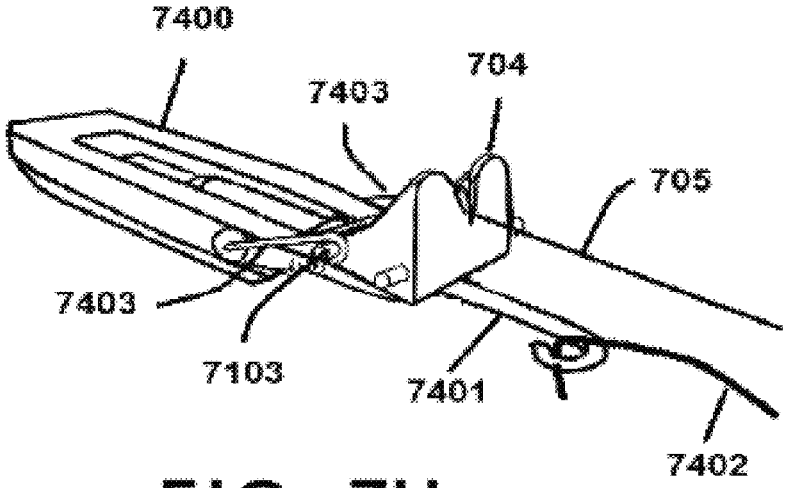

The other arm which receives the transfer device in a dual rapier loom is shown in FIG. 7H, which is the taker arm.

Figure 7I:
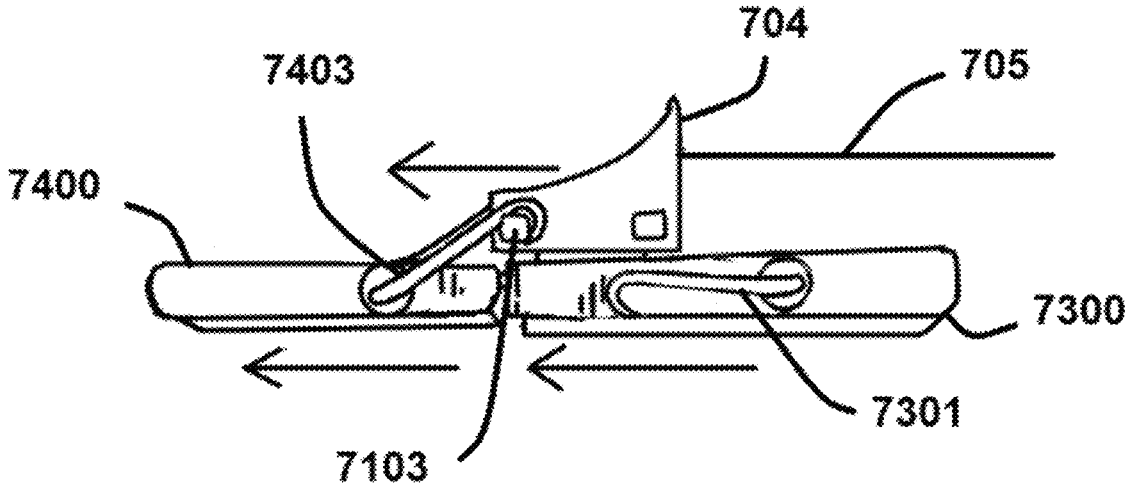

FIG. 7I presents a view of how the transfer device is transferred from the giver arm to the taker arm.

Figure 7J:
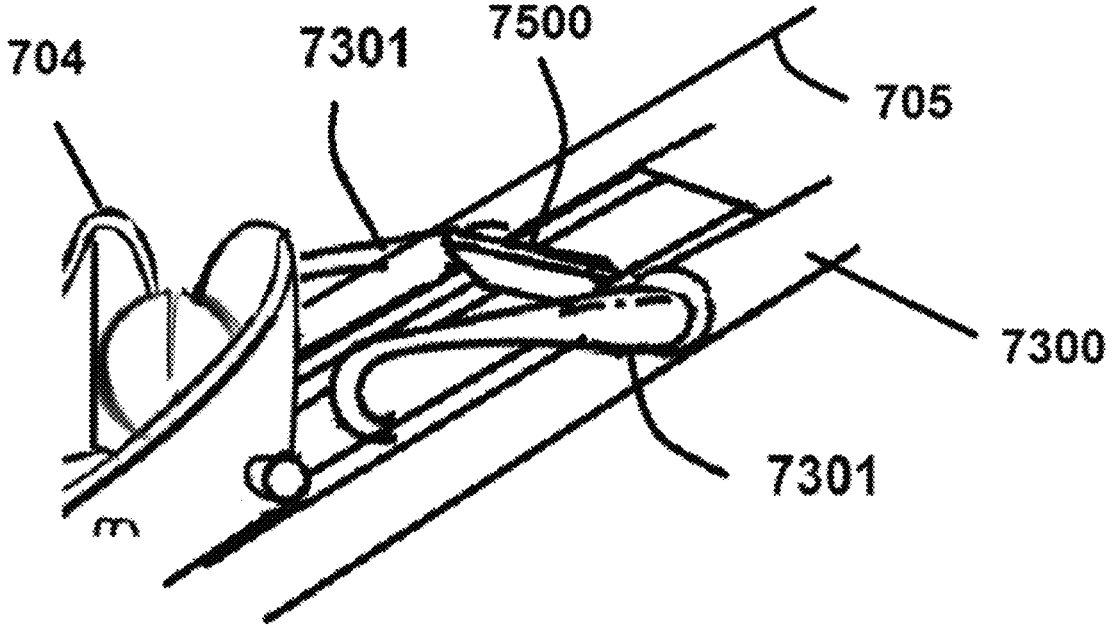

A close-up of the giver arm after the transfer is shown in FIG. 7J.

Figure 7K:
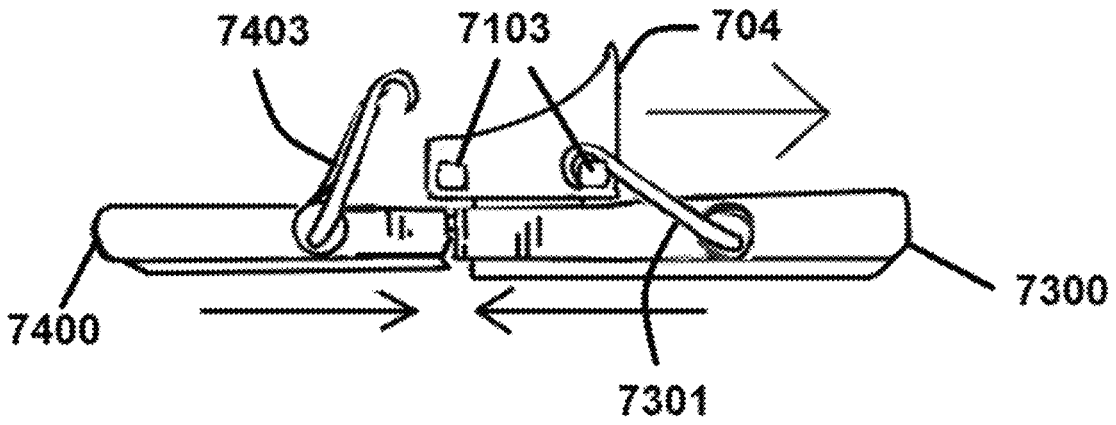

FIG. 7K shows how the transfer device is returned by the taker arm.

Figure 7L:
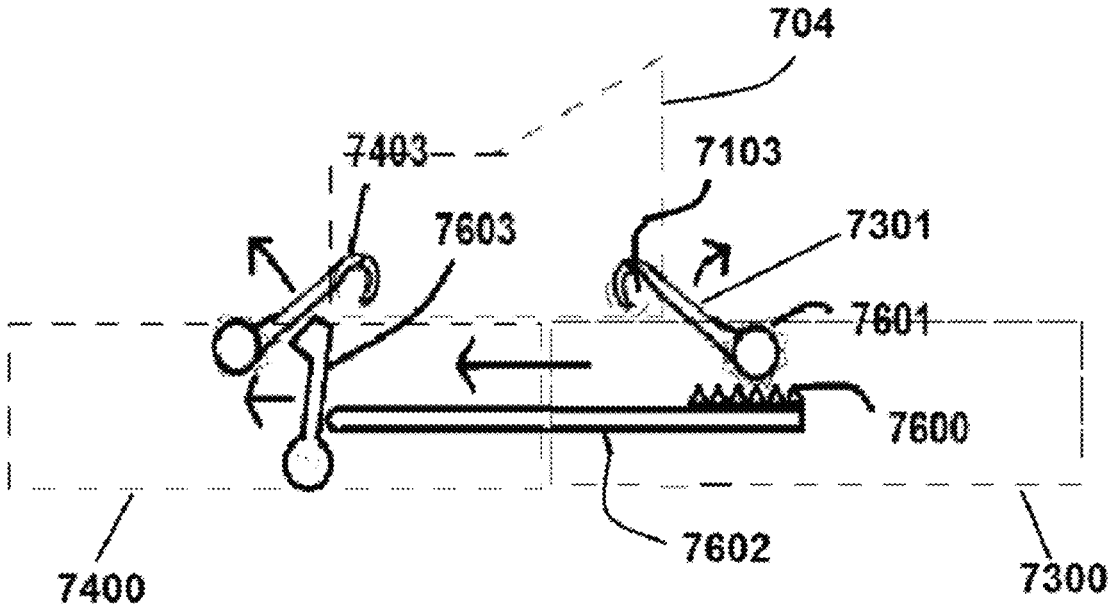

FIG. 7L presents a diagram of how the components of the dual rapier apparatus move during a transfer.

Figure 8:
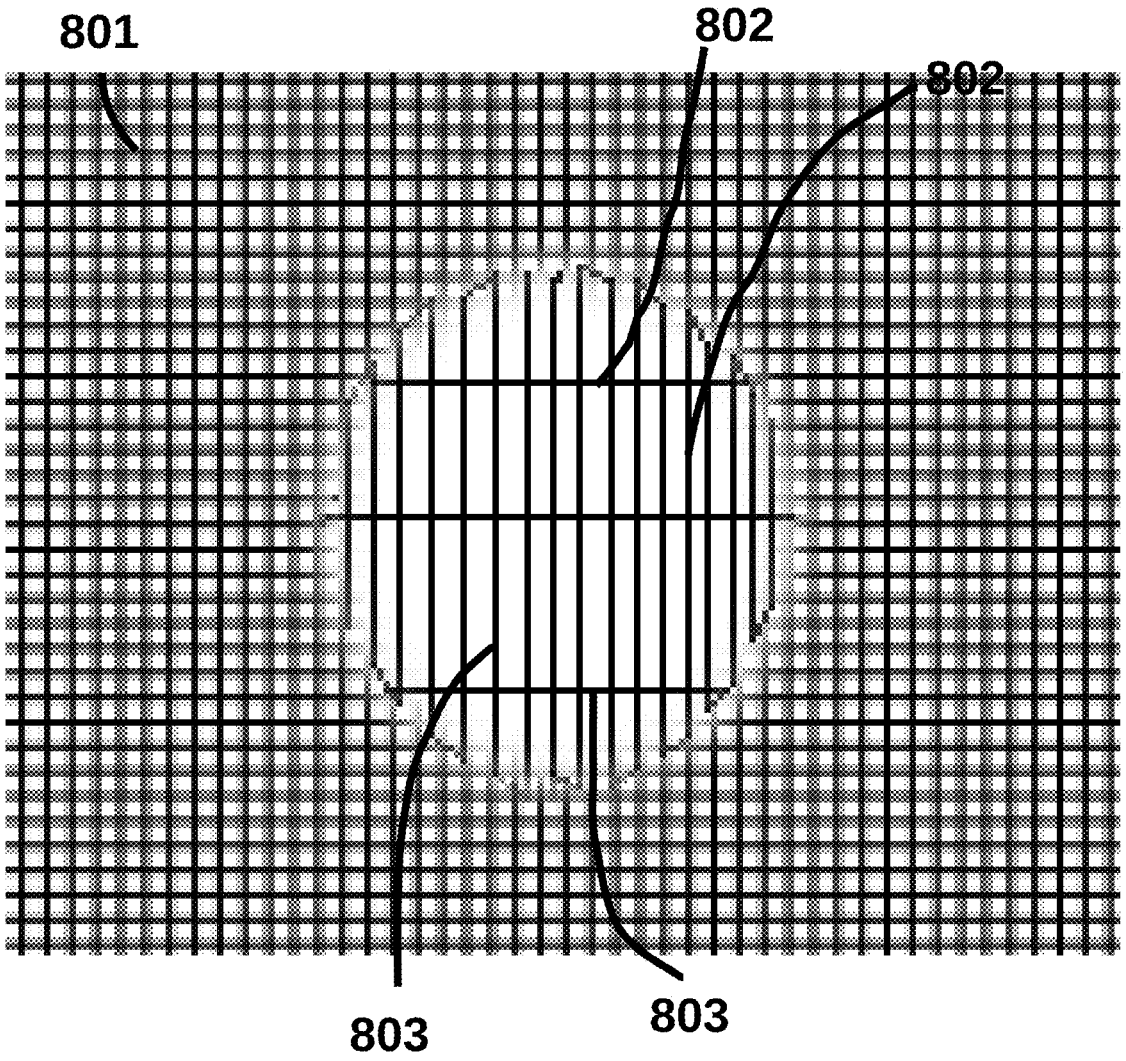

FIG. 8 shows an example of how the invention can be integrated in an area of fabric using darning techniques.

Figure 9:
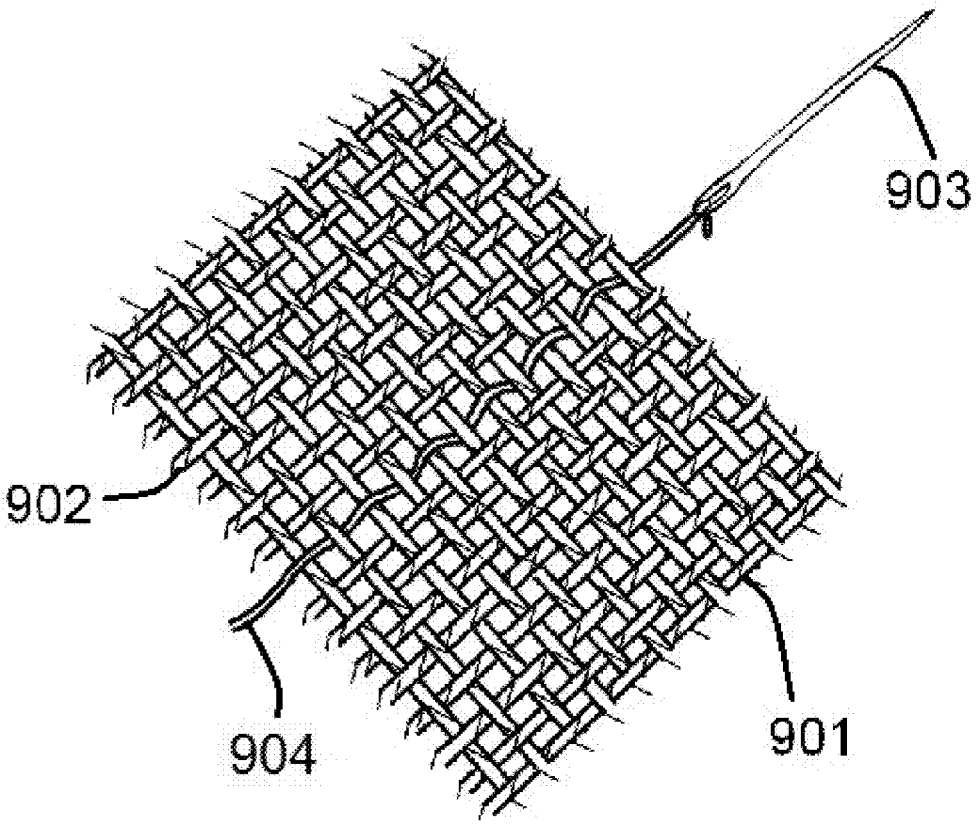

FIG. 9 shows an example of how the invention can be integrated manually in a garment.

Figure 10:
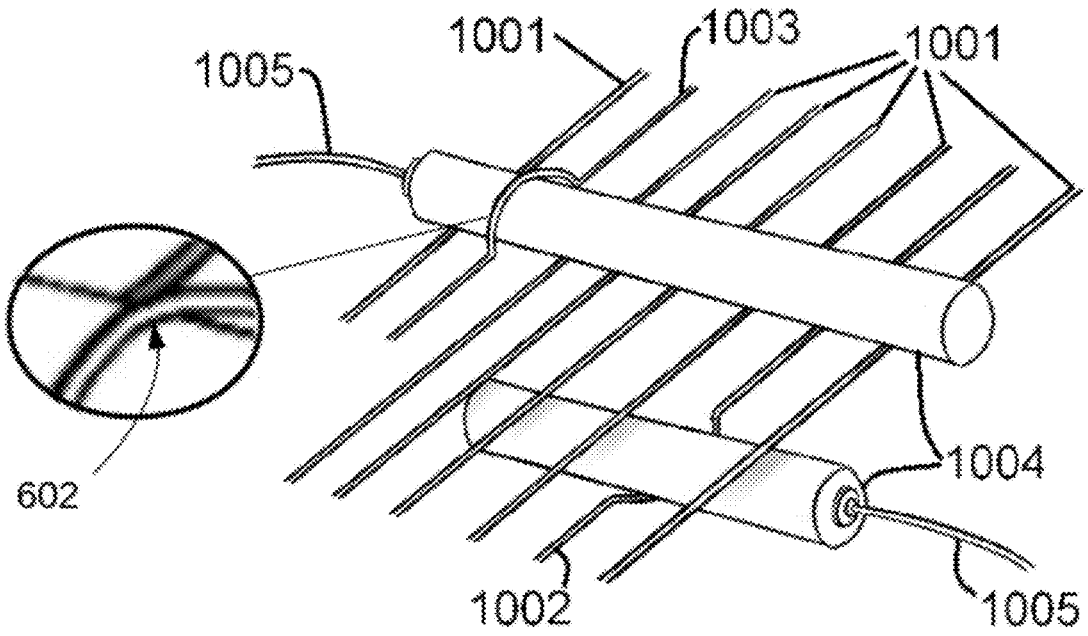

FIG. 10 shows how the unique geometry of the nanoconductor structure integrated in the weave of the cloth supports connection to conducting surfaces and outside electrical circuits.

Figure 11:
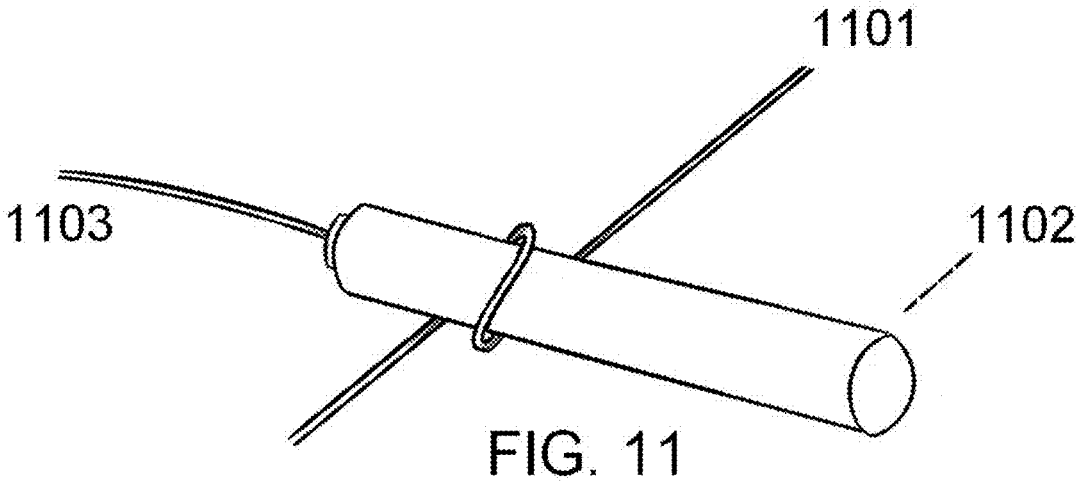

FIG. 11 is an alternative embodiment showing how the nanoconductor structure can alternatively be connected to external conductors, leads or circuits.

Figure 12:
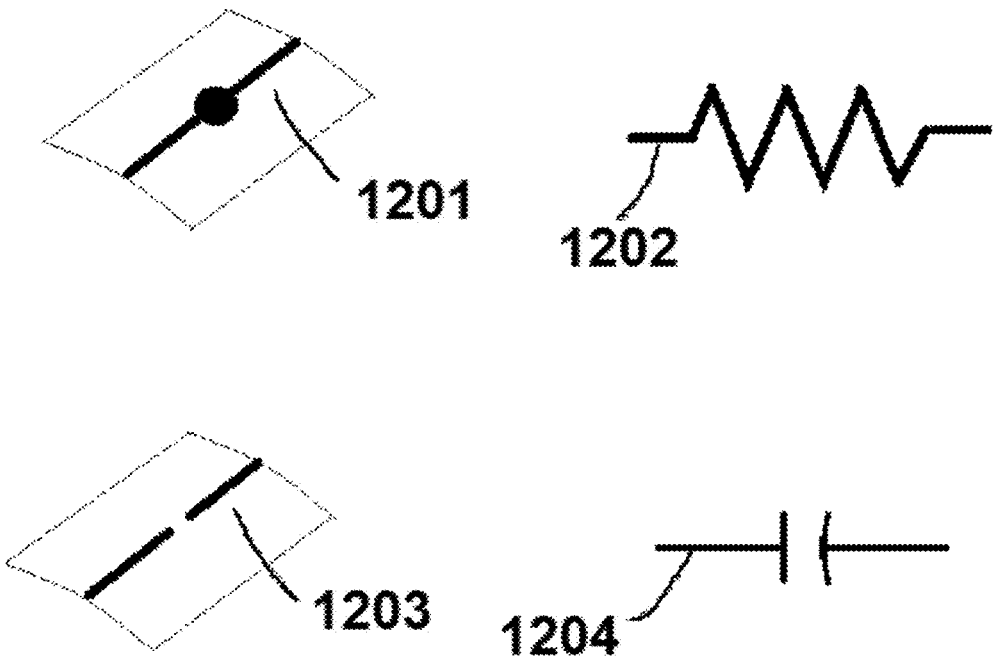

FIG. 12 is diagram showing how the electrical properties of different applications of the nanoconductor geometry can be represented in electrical circuits.

Figure 13:
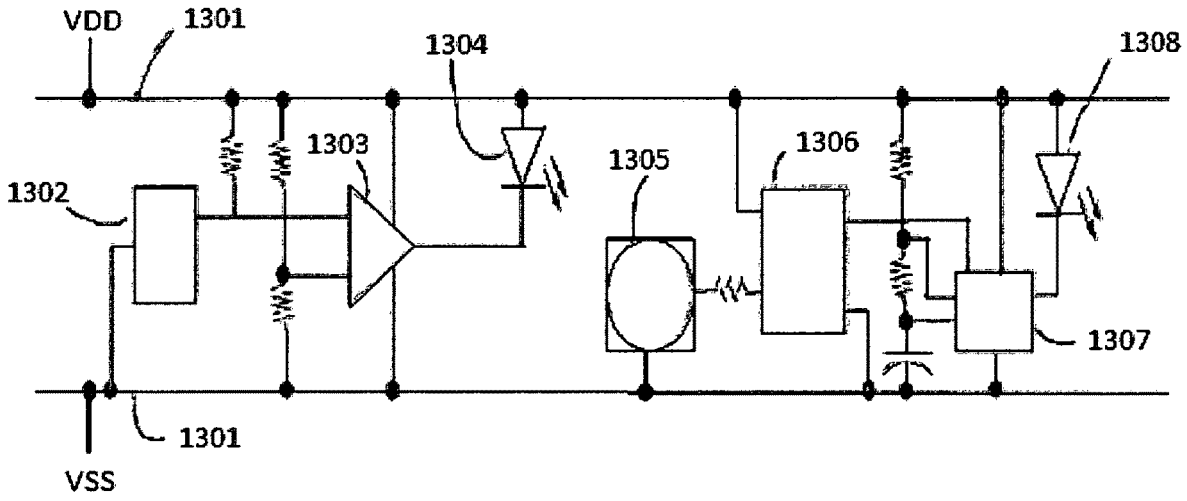

FIG. 13 is a schematic for a simple smart application supported by the invention.

Figure 14A:
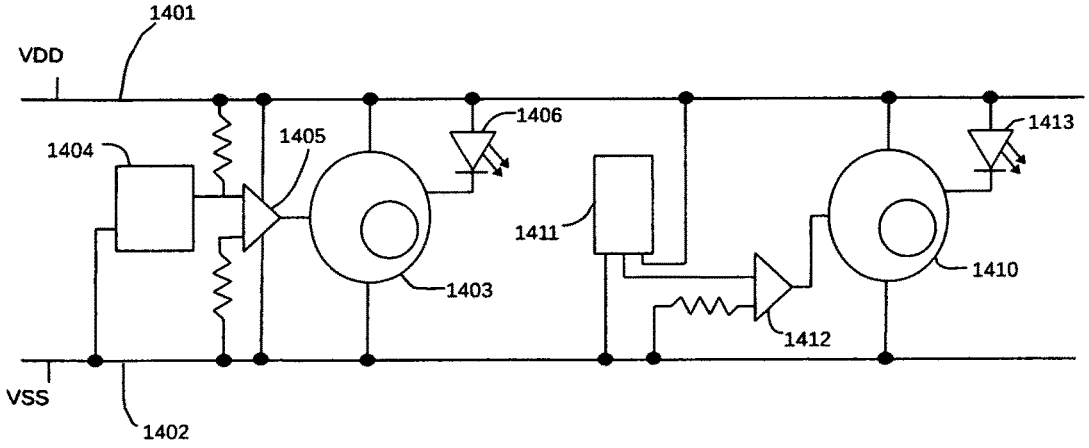

FIG. 14A provides an example of smart application of the invention, showing how components can be grouped within the circuits of the invention.

Figure 14B:
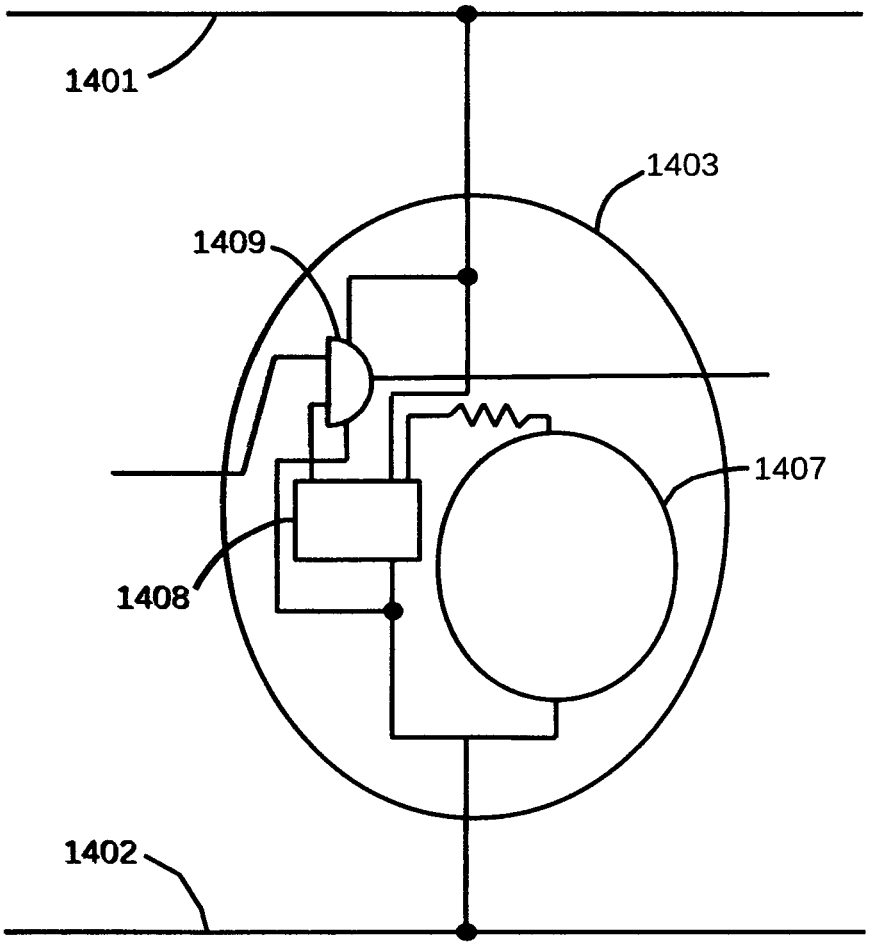

FIG. 14B gives an example of one of the groups which is based on a capsense input component.

Figure 15A:
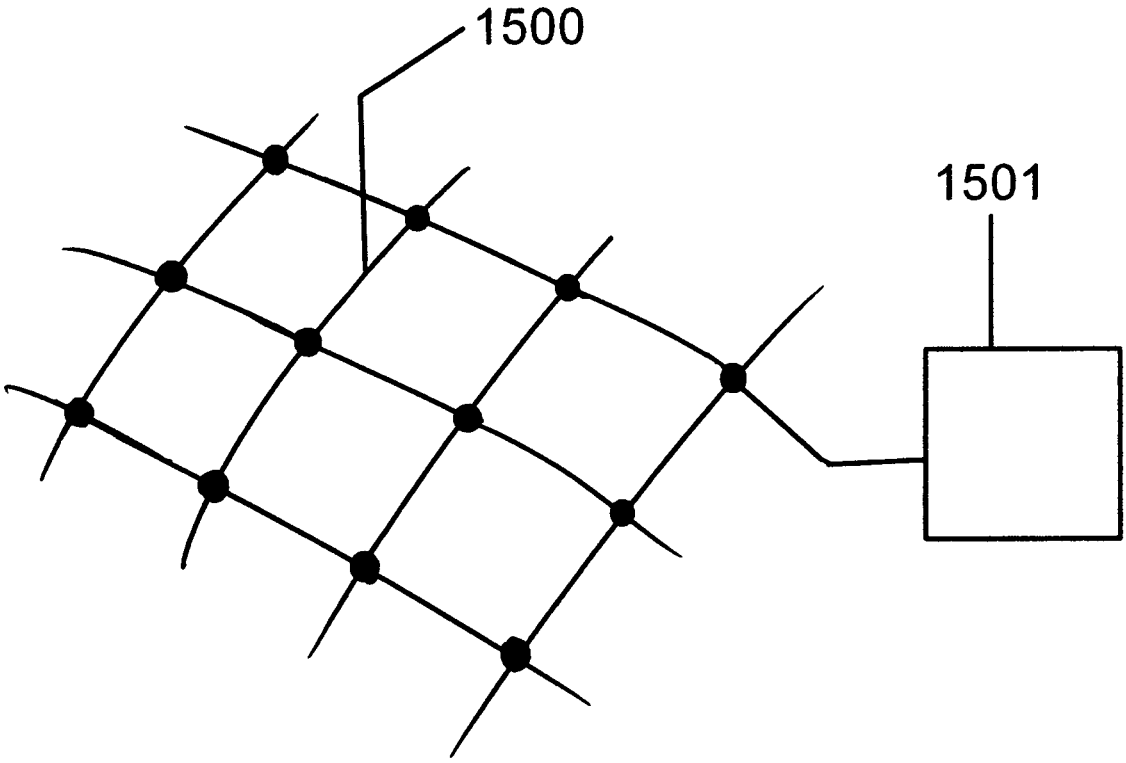
Figure 15B:
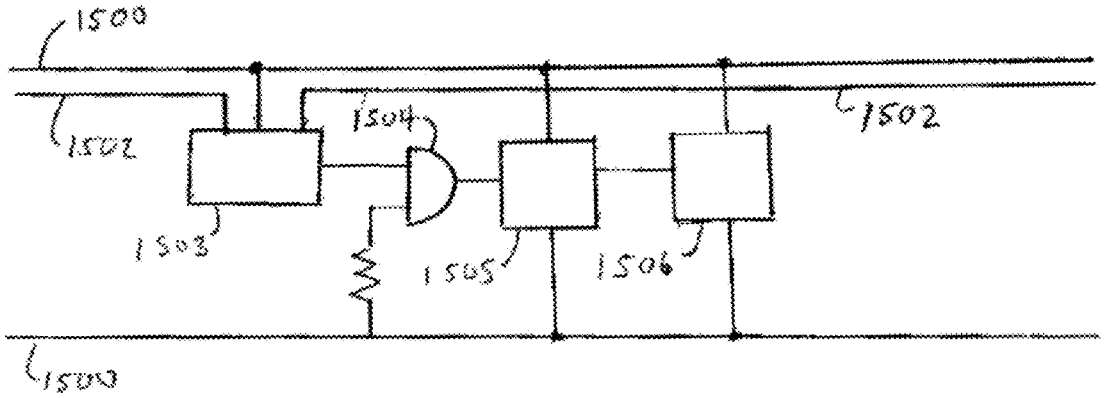
Figure 15C:
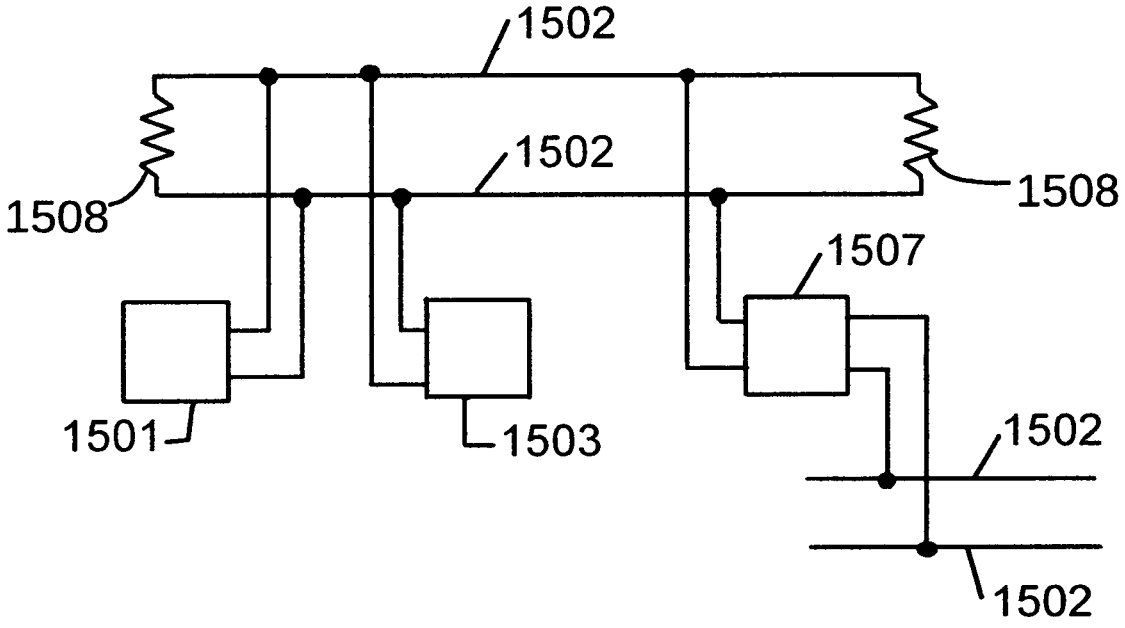

FIG. 15A through FIG. 15C present the preferred embodiment of the invention as a smart application. FIG. 15A shows a wider view of how the invention can be embodied in a lattice arrangement of programmable nodes to provide a number of smart applications.

FIG. 15B provides an example of how a node within the lattice of the invention would provide configurable components which can support different smart applications.

FIG. 15C shows the connection of the nodes to a programmable network which is part of the invention.

Figure 16A:
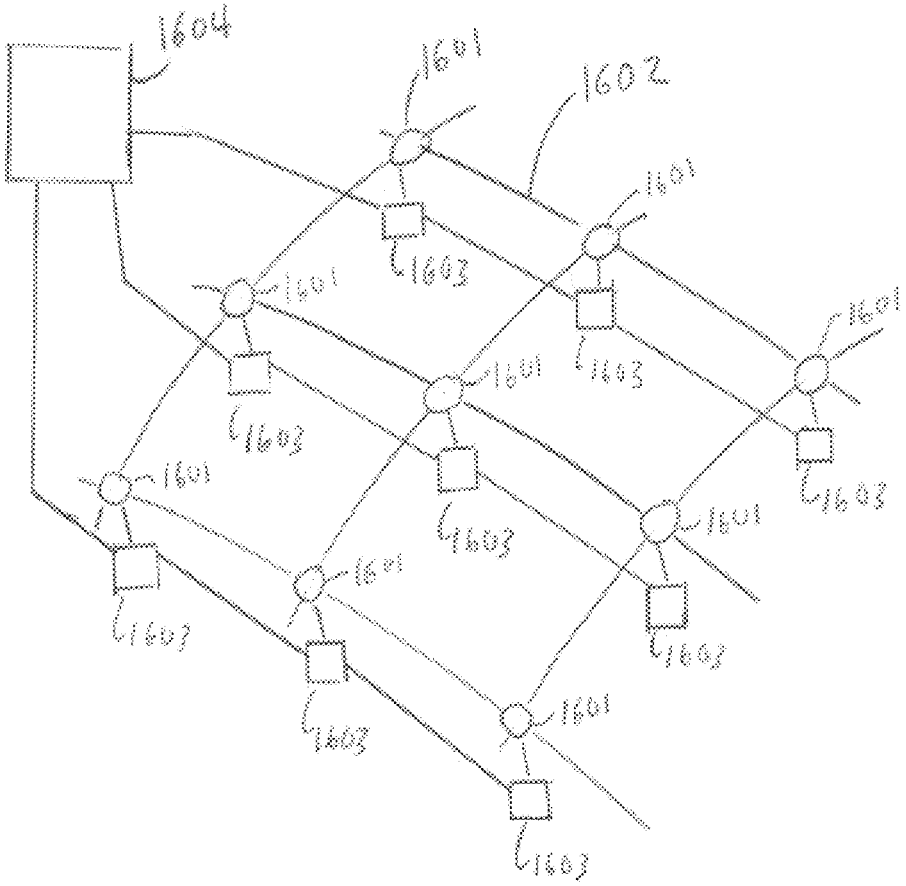

FIG. 16A is a view of the programmable lattice arrangement of the invention which is used as a smart application with re-configurable nodes for use as keypad input devices.

Figure 16B:
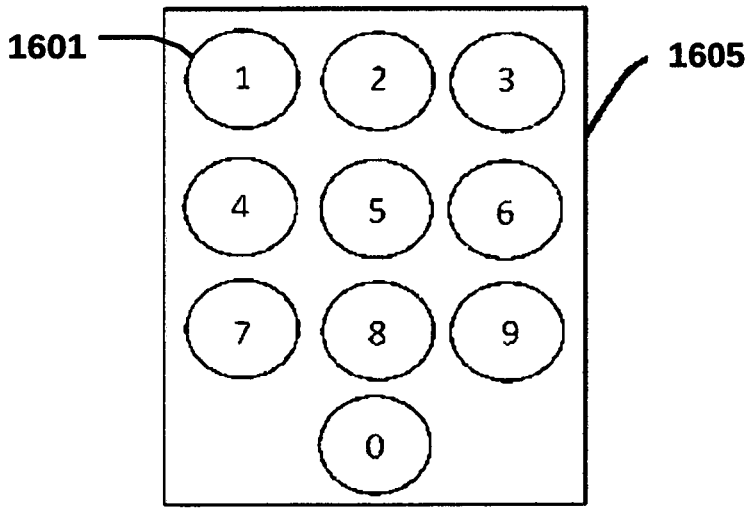

FIG. 16B gives an example of this embodiment used as a keypad.

Figure 16C:
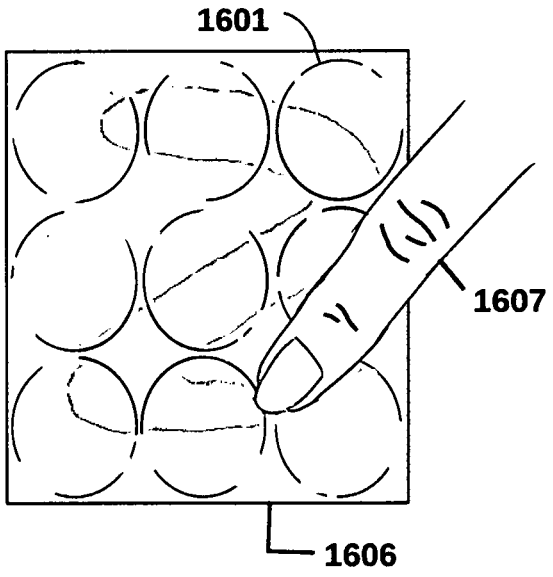

FIG. 16C gives another example of the invention as a touch pad device.

Figure 17A:
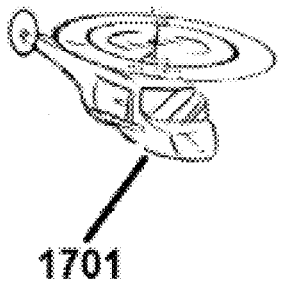
Figure 17A:
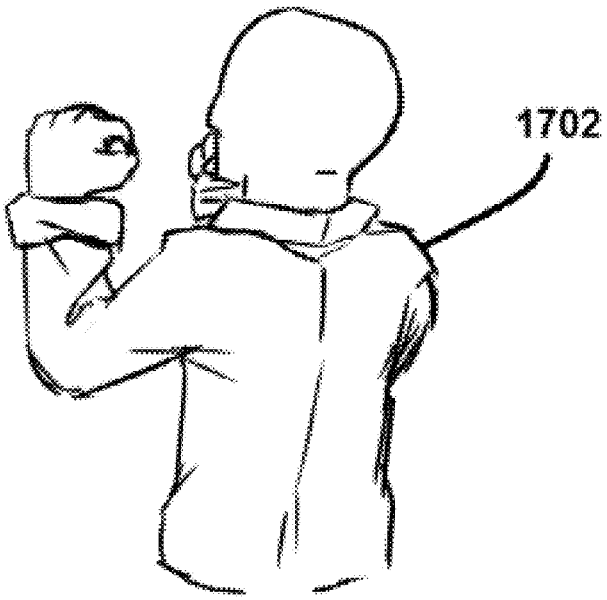

FIG. 17A is an example of how the preferred embodiment can be used as a smart application which is sensitive to a user's arm motions used for ground control of an Unmanned Air Vehicle.

Figure 17B:
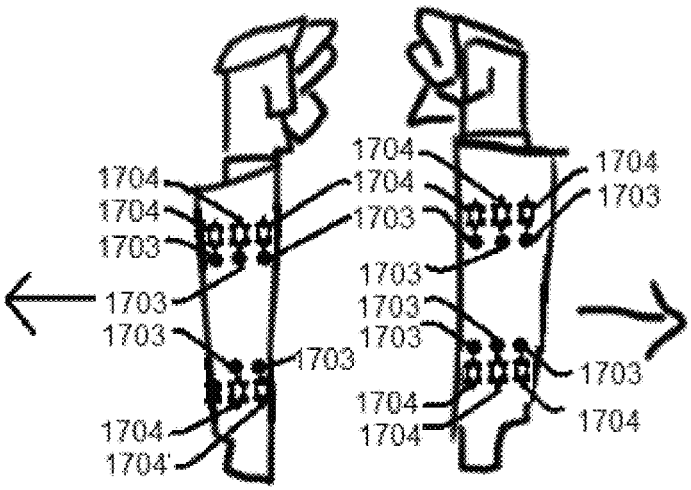

FIG. 17B shows how the invention is used when the user's arms are moved in one direction.

Figure 17C:
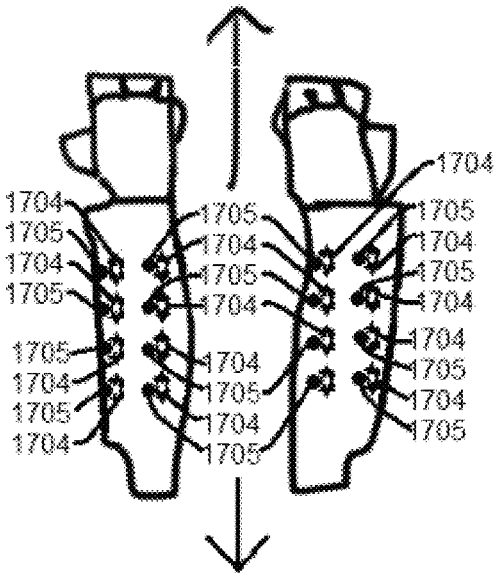

FIG. 17C shows the use of the invention with different arm motion.

DETAILED DESCRIPTION OF THE INVENTION

As used in this specification, the terms "nanoconductor", "nano-scale conductor", "nanoconductor fiber", "nanoscale fiber", "nanoconductor geometry", and "nanoscale geometry" refer to a conducting structure of nanometer scale comprising a combination of metalized, electrospun or similar nanoconductor and a larger textile fiber, such structure running for lengths from centimeters to up to 3 meters of continuous fabric thread.

The term "smart wearable", "smart technology", "smart electronics", "smart circuits" or "smart" refers to electrical circuit or circuits which are integrated with the fabric of the clothing and can be configured to support different circuit paths, electronic applications, or user applications after the technology is woven into the garment. These terms also may be used to refer to the nano-scale integrated components which allow changes to the behavior of the electronic circuits integrated with the clothing.

The following description of the current invention includes the Description of the Preferred Embodiment as well as a description of alternative embodiments and several examples of how the invention can be made and used. Any other use or application of the invention or methods for how it is made which are not specifically contained within this disclosure which are obvious to a person skilled in the art or science are intended to be covered by the current invention.

Figure 1:
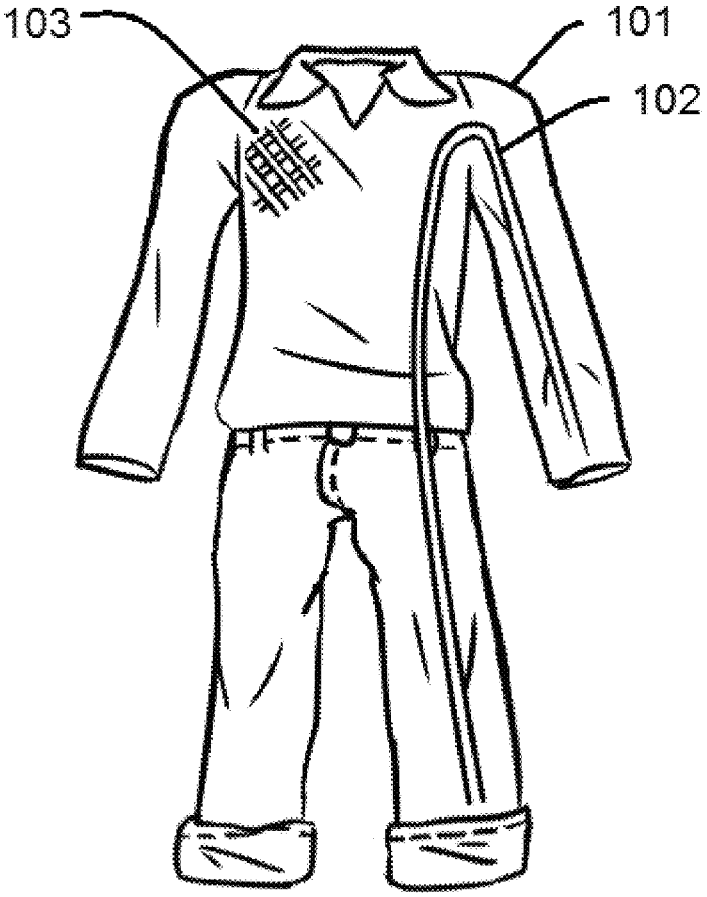
FIG. 1 shows the integration of the invention within a typical article of clothing.

The invention consists of wearable, smart technology which is fully integrated into articles of clothing, an example of which is shown in FIG. 1. 101 is the typical article of clothing used as an example. In this drawing, 101 is shown as an article of clothing which covers most of the body. However, this is just an example and the current invention is intended to be used in any woven cloth article of sizes comprising three fibers thick to articles which would cover multiple users, such as a blanket. Fully integrated into 101 article of clothing is an electronic application 102 comprising one or more nanoconductor structures of sufficient length to run the length of the clothing as shown in FIG. 1. The preferred embodiment is an electronic circuit which integrates the invention's smart application through the length of the garment based on a continuous, fully integrated conductor. An alternative embodiment is one in which the invention's smart application is fully integrated into one article of clothing and optionally connects to the invention's smart application within another article of clothing using the invention's novel connectors, as shown in the example of FIG. 1 for electronic application 102. The electronic application 102 can be specific to the user's requirement, comprising a simple circuit connecting one or more external signaling devices with an external control device or comprising smart technology of the invention along the length of 102, depending on the needs of the user. A separate electronic application 103 of the invention is shown as an example comprising a smaller length of nanoconductor fibers limited to just an area of the article of clothing, depending on the needs of the user.

The foregoing description provided a few examples of how the invention can be fully integrated with an article of clothing. The remainder of the description will disclose the novel design of the invention beginning with how it can be fabricated and continuing with a description of its materials and geometry and how the smart technology comprising the invention supports various novel applications based on its design.

Figure 2:
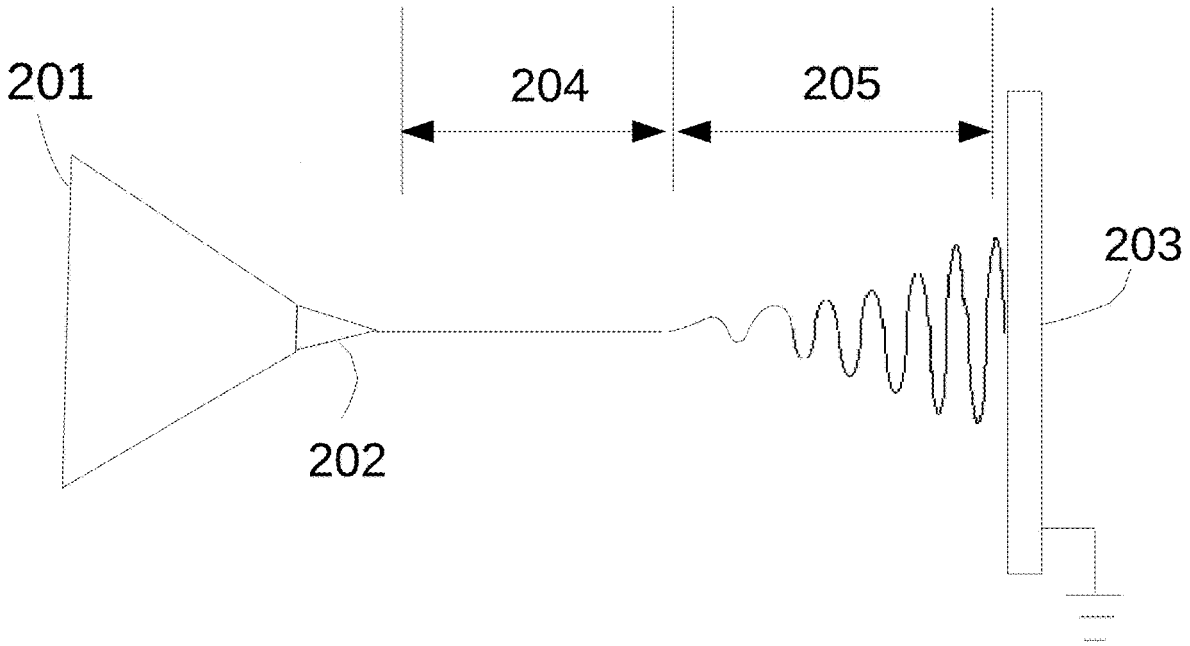
FIG. 2 is a diagram showing the typical technique used for electrospinning nano fibers.

FIG. 2 provides a diagram of a typical electrospinning technique which supports the fabrication of the current invention. This diagram depicts an apparatus that can be used to produce the nanoscale fibers which are part of the fabrication process disclosed with the invention. 201 is an electrospinning nozzle, which has a high voltage applied. The voltage is applied to the nozzle 201 so that the polymer material fed to the nozzle produces a critical point at the end of the nozzle 201, the Taylor cone 202, from which a stream emits and travels toward the cathode 203. The first portion of the path to the cathode 203 experiences ohmic flow 204, where the stream particles are uniformly accelerated towards the cathode 203. Closer towards the cathode 203, the particles of the stream start reacting towards each other as charge migrates outward and a spiraling of the stream becomes a fiber within this region, known as convective flow 205. Depositing of the fiber on the cathode 203 produces mats of nanoscale fibers which can be used further in fabrication of the invention. The details of the electrospinning technique including sizes, voltages, timing, part supplies, and other details of the process which produces a nanoscale fiber for use in current invention are similar to those used by persons skilled in the art or science of electrospinning and its related fields.

Figure 3:
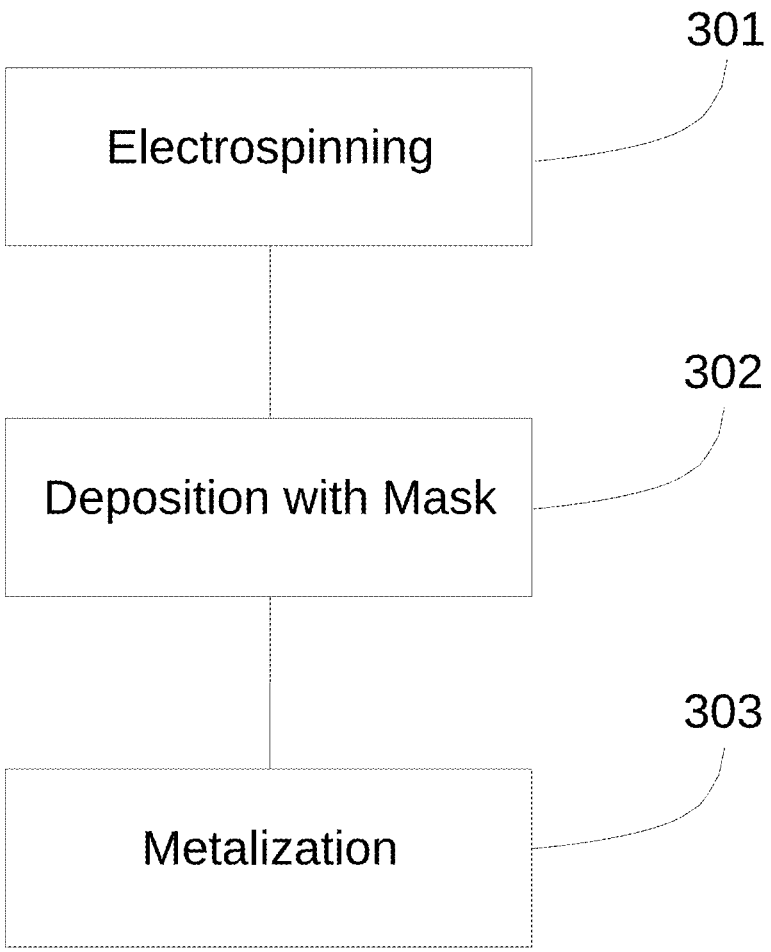
FIG. 3 is block diagram showing the fabrication process of the preferred embodiment of the invention.
Figure 4:
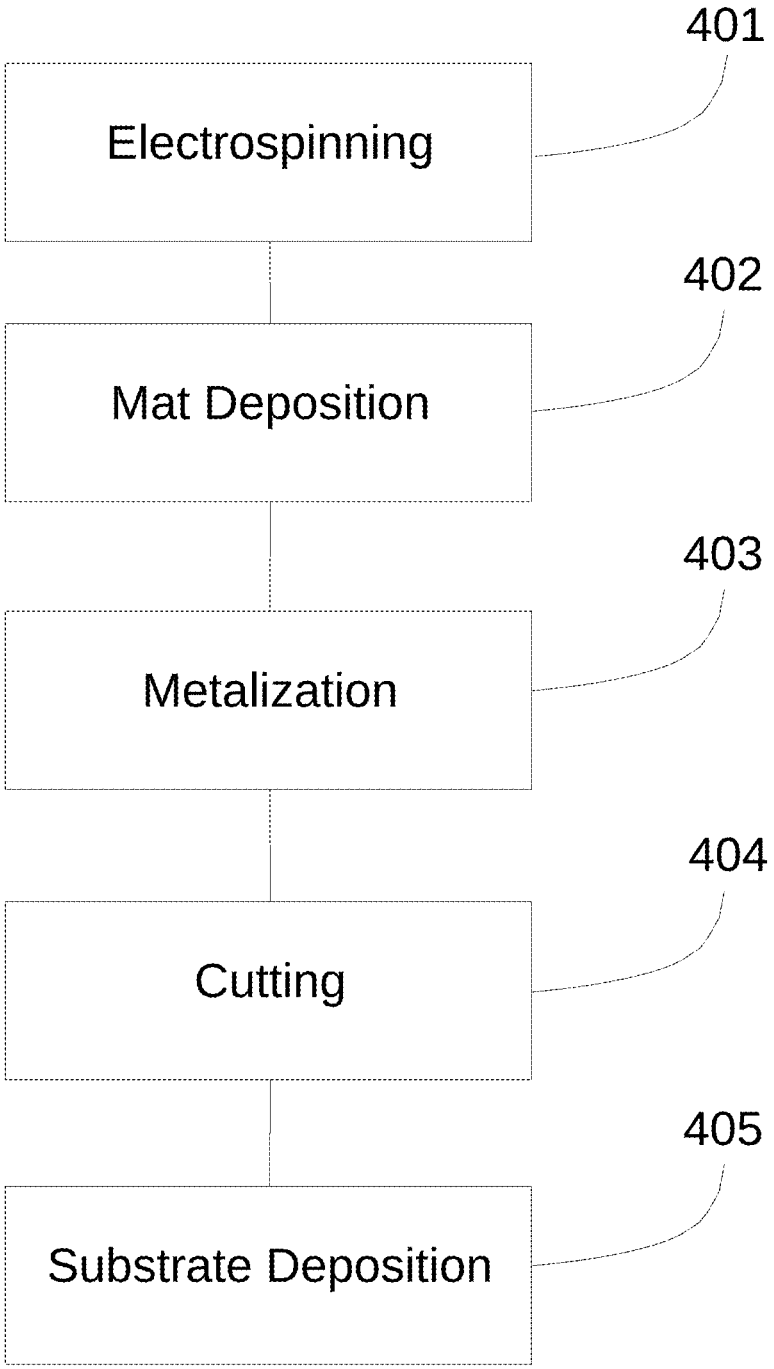
FIG. 4 is a block diagram showing an alternative fabrication process for the invention.

FIG. 3 and FIG. 4 disclose the steps comprising the methods to fabricate the nanoconductor fibers for the invention. FIG. 3 shows the fabrication method for the preferred embodiment of the invention based on an electrospinning technique as that described in FIG. 2. Step 301 uses the electrospinning apparatus to produce the stream of nanoscale fibers from at least one polymer compound. In the preferred embodiment, a polyacrylnitrile (PAN) polymer is used. Various other filament-generating methods can be used to produce the nanoscale fibers which are similar to those produced by electrospinning and a process as described in FIG. 3 which is based on one of these other methods for Step 301 which is obvious to anyone skilled in the art is within the scope of the invention and intended to be covered by its claims. In the preferred embodiment, the mask Step 302 is used during the deposition of the polymer nanoscale fiber to control the width of the nanoscale fiber deposition. A polymer-based fiber of sufficient strength and size is used to capture the deposit of electrospun nanoscale fiber for this invention. In the preferred embodiment, a polyester fiber made of polyethylene terephthalate (PET) with an average cross-sectional diameter of 150 to 200 microns is fixed between the mask and the cathode of the electorspinning apparatus during Step 302. In other embodiments, multiple mask configurations and polymer fiber substrates may be used during Step 302. Various other polymer materials can be used to produce the nanoscale fibers or as the macroscopic polymer fiber and such material which are obvious to a person skilled in the art are intended to be covered by the instant invention. Following deposition, Step 303 metallizes the nanoscale fibers deposited on the macroscopic polymer fiber using electroplate techniques. In the preferred embodiment, silver is used to metalize the nanoscale fibers in Step 303. Other embodiments can use other metallic materials such as copper, gold, nickel and others. Another embodiment uses carbon as the conductive material added through carbonization in Step 303. Silver metalization is the preferred embodiment because it has superior properties over other metallic compounds and carbon nanoconductors have been found to be harder to deposit on substrates such as the macroscopic fiber of the invention and are more brittle, making them difficult to apply to the invention.

An alternative method for fabricating the nanoconductor structures of the invention is disclosed in FIG. 4. Step 401 uses an electrospinning apparatus as shown in FIG. 2 to create nanoscale fibers from a polymer such as PAN. Various other filament-generating methods can be used to produce the nanoscale fibers which are similar to those produced by electrospinning and a process as described in FIG. 4 which is based on one of these other methods for Step 401 which is obvious to anyone skilled in the art is within the scope of the invention and intended to be covered by its claims. Step 402 comprises the deposition step of the electrospinning process. In this case, no mask or macroscopic fiber substrate is used as in the preferred embodiment of FIG. 3. Step 402 deposits the nanoscale fibers on a planar substrate without a mask, so that nanoscale fiber mats are created with an approximate size of 10 cm width. In Step 403, the nanoscale fiber mats are metalized through electroplating to create nanoconductor mats. Silver is used in this embodiment for the same reasons as in the preferred embodiment's method in FIG. 3, but other metals could be used in this step as part of other embodiments. Because of the difficulty found when working with the brittle properties of carbonized nanoconductor mats, carbon is not a candidate for the method shown in FIG. 4. The metalized mats are cut in Step 404 to reduce their width to the nano-scale size of the invention. The alternative method disclosed in FIG. 4 has higher risk of damaging the metalized fibers and requires further investigation. Various embodiments of this method which use different means of cutting the nanoconductor mats to reduce the risk of Step 404 are included in the method shown in FIG. 4. Step 405 uses the smaller nanoconductor mats to deposit nanoconductor material on the macroscopic polymer fiber of the invention, which can be the polyester PET fiber. A uniform nanoconductor geometry may be more difficult to achieve with the method of FIG. 4. Various other polymer materials can be used to produce the nanoscale fibers or as the macroscopic polymer fiber and such material which are obvious to a person skilled in the art are intended to be covered by the instant invention.

Figure 5:
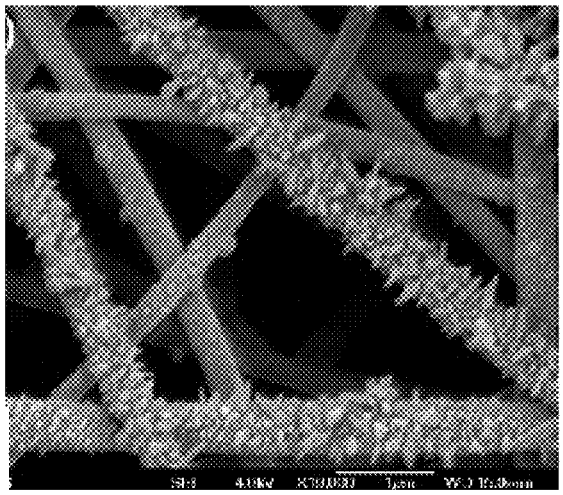
FIG. 5 is an image showing nano fibers produced by electrospinning.

FIG. 5 is an image showing an example of the nanoconductor mats produced through an electrospinning process similar to that disclosed in FIG. 4. This view is an enlarged view of an example which is approximately 10 microns wide, much larger than the nanoconductor geometry expected to be achieved with the preferred embodiment in the method disclosed in FIG. 3. Various mask types and patterns can be used to produce the nanoscale fiber dimensions of the method disclosed in FIG. 3 and all such masks and masking methods which are obvious to a person skilled in the art are intended to be covered by the current invention.

Figures 6A, 6B:
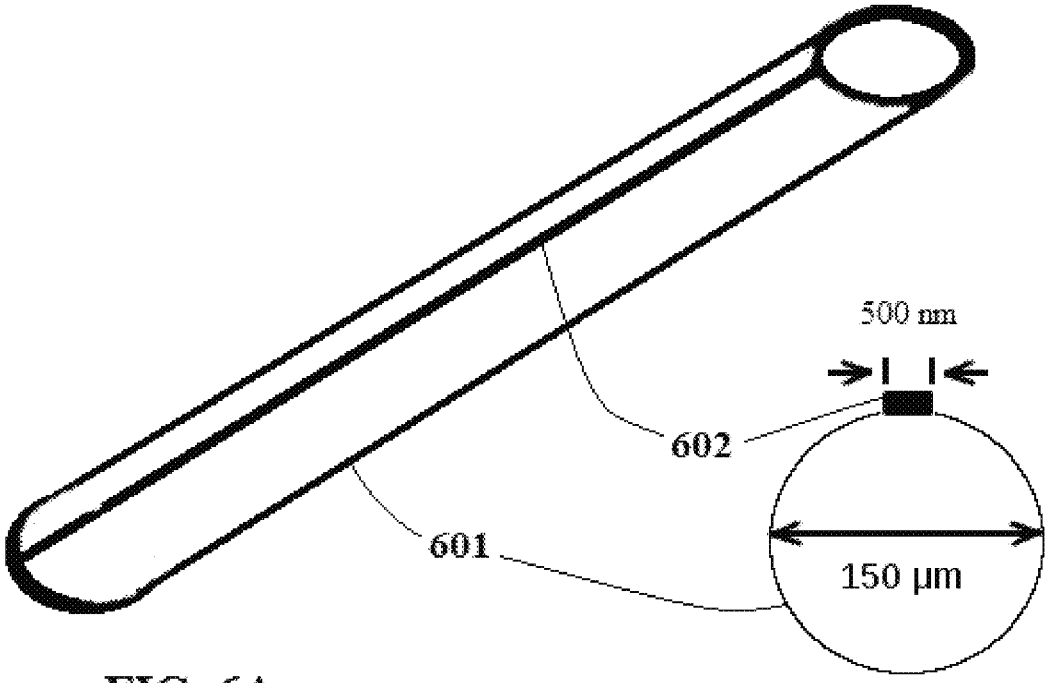
FIG. 6A shows the longitudianl geometry of the nanoconductor fibers.
FIG. 6B shows the cross-sectional geometry of the nanoconductor fibers used in the invention.

FIG. 6A and FIG. 6B show the geometry of the nanoconductor structures produced in the methods disclosed in FIG. 3 and FIG. 4. The longitudinal geometry of the nanoconductor fiber is illustrated in FIG. 6A. FIG. 6B shows the cross-sectional geometry of the same nanodonductor fiber. 601 is the macroscopic fiber used as a final substrate in the methods of FIG. 3 and FIG. 4. In the preferred embodiment, this is a polyester PET fiber of approximately 150 microns as shown in the cross-sectional aspect of FIG. 6B. On top of one cross-sectional hemisphere in FIG. 6B is the nanoconductor strip 602. In the preferred embodiment fabricated using the method disclosed in FIG. 3, this nanoconductor strip 602 is approximately 500 nm wide and runs the length of the macroscopic fiber 601 as shown. The use of a mask in the method disclosed in FIG. 3 provides a high level of control to the deposition of the nanoconductor strip 602 on the macroscopic fiber 601. For this reason, the length of the nanoconductor strip 602 can be tailored to suit the user's application and in alternative embodiments, the nanoconductor strip 602 will not run the whole length of the macroscopic fiber 601 as it is shown in FIG. 6A.

A novel feature of the geometry shown in FIG. 6A and FIG. 6B is that the nanoconductor strip 602 is deposited to only one side of the cross-section of the macroscopic fiber 601. This feature of the geometry supports several novel aspects of the invention, including a novel means of weaving the nanoconductor fibers into the textile, a novel means of connecting the nanoconductor fibers to external conducting surfaces and electronic circuits, and a novel means of creating smart circuits and technology within the garment. The preferred embodiment uses this geometry. The alternative method disclosed in FIG. 4 provides other embodiments in which the nanoconductor strip 602 is not restricted to a single side of the cross-section of the macroscopic fiber 601. Various embodiments based on the position of the nanoconductor fibers on the cross-section of the macroscopic fiber which are obvious to a person skilled in the art are intended be covered by the current invention.

FIG. 7A shows an example of how an apparatus, such as a modified loom, can use the novel geometry of the invention shown in FIG. 6A in order to weave the nanoconductor fibers produced by one of the methods in FIG. 3 or FIG. 4 into a common textile. This approach is best for larger garments when the nanoconductor fibers of the invention will cover most of the length of the material. A rapier loom is preferred because its design allows for modification of the pick which will support the uniform orientation of the invention's nanoconductor fiber's geometry in various embodiments In the preferred embodiment, the invention's nanoconductor fibers are fully integrated into the weave of a poly-cotton blend material with the orientation of the nanoconductor strip facing up. Single or multiple nanoconductor fibers can be inserted in place of some of the warp threads in order to support the interconnection of the nanoconductor fibers within the garment for various smart applications of the invention.

FIG. 7A is a sketch of a single rapier arm loom, which is the preferred embodiment. In the preferred embodiment, 701 is a view of the rapier arm at the point of insertion, drawn not to scale. The rapier arm 701 is shown carrying the weft yarn 702 as it is inserted into the shed 703. A transfer device 704 is attached to the end of the rapier arm 701, which carries a nanoconductor fiber 705 which is fed from the spool 706. The spool 706 is wound so that the nanoconductor fiber 705 is fed to the transfer device 704 in a chosen orientation. The transfer device 704 holds the nanoconductor fiber 705 in a fixed position as it inserts it though the shed 703 so that the nanoconductor fiber can be woven into the weave of the cloth with a fixed orientation. In the preferred embodiment, the nanoconductor strip 602 on the nanoconductor fiber 705 is pointed upwards, but the transfer device 704 and spool 706 allow the loom operator to change the orientation of the nanoconductor fiber 705 to support any other orientation with respect to the plane of the weave. Warp yarn 707 is one of the many warp yarns that are suspended in the loom to create the shed 703 for the rapier arm 701. The warp yarns are suspended through the reed 708, which beets the nanoconductor fiber 705 into the weave after its insertion. The fell and cloth 709 into which the nanoconductor fiber 705 is woven is collected on a takeup roll, which is used as material for a garment comprising the integrated nanoconductor fiber 705. In addition to the nanoconductor fiber 705 in the weft yarn direction, one or more of the warp yarns can be replaced by a warp-directed nanoconductor fiber 710 in order to allow interconnection of nanoconductor fibres within the cloth. One warp-directed nanoconductor fiber 710 is shown in the preferred embodiment of FIG. 7A, but multiple warp-directed nanoconductor fibers 710 can be used in other embodiments.

FIG. 7B through FIG. 7D show different views of the transfer device 704. FIG. 7B shows the back view of the transfer device 704. In this view, the transfer carriage 7101 is shown from the back, with the retaining disk 7102 contained within the transfer carriage 7101. The retaining disk 7102 comprises a thin slot which holds the nanoconductor fiber 705 when the transfer device 704 carries the nanoconductor fiber 705 into the shed 703 of the loom. On each side of the transfer carriage 7101 is a projecting pin 7103, which is used in alternative embodiments to move the transfer device 704 during nanoconductor fiber 705 insertion. The preferred embodiment of the invention does not require the projecting pins 7103 and would not comprise these structures. FIG. 7C shows the front view of the transfer device 704, comprising the transfer carriage 7101, the retaining disk 7102, and the optional projecting pins 7103. The front view in FIG. 7C presents a clearer view of the retaining disk 7102, which is attached within the walls of the transfer carriage 7101. FIG. 7D shows the side view of the transfer device 704. In this view, the transfer carriage 7101 is obvious and the optional projecting pins 7103 are shown on the side of the device. The preferred embodiment does not provide the projecting pins 7103. The retaining disk is not visible when viewing the transfer device 704 from the side, but the nanoconductor fiber 705 which is held by the retaining disk during operation is shown.

FIG. 7E is a close-up view of the top of the retainer disk 7102 with the nanoconductor fiber 705 inserted into the holding slot. This view shows how some embodiments of the invention can include position sensor 7104 probes which are part of a micro-circuit that determines the orientation of the nanoconductor fiber 705 by measuring conductivity of the part of the fiber the probes are contacting. In the preferred embodiment of the invention, the orientation of the nanoconductor fiber 705 is such that the nanoconductor strip 602 is facing up. In this orientation, the position sensor 7104 probes are not contacting the nanoconductor strip 602 so that the conductivity between the probes is lowest. The sensor measurements of the probes are carried back to a meter 7105 through a micro-circuit along the surface of the retaining disk 7102. The connecting interface 7106 is required in the embodiments of the invention which allow movement of the transfer device 704 with respect to the rapier arm 701 and is used to communicate the position sensor 7104 signals to a meter 7105 which is located external to the rapier arm. Communication of the signal in this case can be by voltage transformation, electrical connection through bushings or other contacts which allow movement, or by non-contact means such as wireless or radio frequency signals. The preferred embodiment of the invention does not support movement of the transfer device 704 with respect to the rapier arm 701 and the connecting interface 7106 is not used. Other embodiments can include the connecting interface 7106 and any such connecting interface which is obvious to a person skilled in the art is within the scope of the present invention and covered by its claims. The meter 7105, which can be located separate from the transfer device 704 and provide indication to the loom operator, allows the operator to monitor the insertion of the nanoconductor fiber 705 and provide alarms if the position sensor 7104 senses a change in the orientation of the nanoconductor fiber 705.

The foregoing description disclosed the preferred embodiment of a weaving apparatus, which is based on a single rapier arm loom. Alternative embodiments of the invention include other types of looms or apparatus which can use the transfer device 704 to insert the nanoconductor fiber 705 into the weave of the cloth. Other types of looms which would support these alternative embodiments include projectile, air jet, multiphase and hand looms, and all such looms which are modified to use a device such as the transfer device 704 in any way which is obvious to a person skilled in the art in order to weave the nanoconductor fiber 705 as an integrated part of the cloth are intended to be covered by the scope of the present invention and covered by its claims. Other types of looms which do not allow for the insertion of a fiber in a fixed orientation, such as water jet looms, are not within the scope of the present invention.

The alternative embodiment which is based on a projectile type loom is shown in FIG. 7F. FIG. 7F shows how the transfer device 704 disclosed above for the transfer of the nanoconductor fiber 705 across the weft of the loom can be used with a projectile from a projectile loom. In this view, projectile 7201 is loaded in the pick shoe 7202, which is ready to be launched through the weft by the pick lever 7203. The weft yarn 7204 is attached to the projectile for insertion through the shed. In this alternative embodiment, the transfer device 704 and nanoconductor fiber 705 are attached to the rear of the projectile, which allows insertion of the nanoconductor fiber 705 through the shed with a fixed orientation. In this embodiment, the transfer device 704 can be an attachable device which is removed manually after the projectile arrives on the receiving end of the shed.

The preferred embodiment disclosed above is based on a single rapier arm loom. An alternative weaving apparatus for this invention is a modified dual rapier arm loom. FIG. 7G to FIG. 7H show how the transfer device 704 can be used as part of a dual rapier arm loom to perform the same weaving effect as the preferred embodiment. FIG. 7G is a drawing of the giver arm 7300, which is one of the dual rapier arms used in the alternative embodiment. The invention's transfer device 704 is shown in the default position on top of the giver arm 7300. In the preferred embodiment, the transfer device 704 was fixed on the single rapier arm of that embodiment and did not require the use of the projecting pins 7103. In the alternative embodiment with two rapier arms, the transfer device 704 is designed to move along the longitudinal axis of the giver arm 7300 so that it can be transferred to the other arm in the middle of the shed. The projecting pins 7103 are used to support the movement of the transfer device 704 in the alternative embodiment. Forward of the transfer device 704 and on the side of the giver arm 7300 are two return arms. One return arm 7301 is shown in FIG. 7G. This return arm 7301 is used to engage the projecting pins 7103 after transfer of the transfer device 704, when the giver arm 7300 is returning to the default position. In FIG. 7G, which shows the default position, one return arm 7301 is shown in the down position, which is the default position.

The other rapier arm of the dual rapier arm embodiment is shown in FIG. 7H. In FIG. 7H, the taker rapier arm 7400 is shown with the transfer device 704 and nanoconductor fiber 705 already transferred from the giver arm 7300. The giver arm 7300 of FIG. 7G is not shown in this view. The taker arm pick 7401 and weft yarn 7402 are shown in this figure, although the alternative embodiment would normally not insert a weft yarn at the same time that the transfer device 704 and nanoconductor fiber 705 are being transferred across the shed. Other alternative embodiments may transfer both at the same time as shown in the figure. In FIG. 7H, the taker arm 7400 has just captured the transfer device and carried it away from the giver arm 7300. A capture arm 7403 is shown in this view after it has attached to the projecting pin 7103, shown on the front side of the taker arm 7400 and transfer device 704. The other capture arm 7403 is shown capturing a second projecting pin 7103, which is not in view because it is on the other side of the transfer device 704.

FIG. 7I depicts the operation of the alternative embodiment based on dual rapier arms at the point in time when the giver arm 7300 meets the taker arm 7400 at the middle of the shed. In this case, a capture arm 7403 on each side of the taker arm 7400 attaches to the projecting pin 7103 of the transfer device 704 and transfers the transfer device 704 and nanoconductor fiber 705 away from the giver arm 7300 and onto the top of the taker arm 7400, where the transfer device 704 is carried through the remainder of the shed. This action inserts the nanocunductor fiber 705 through the width of the shed with a fixed orientation. The return arm 7301 of the giver arm 7300 is shown in this figure in its default position (down), where it remains until the transfer device 704 is transferred off the top of the giver arm 7300.

FIG. 7J shows the operation of the return arm 7301 when the transfer device 704 is captured by the taker arm 7400. At this point, the transfer of the transfer device 704 and nanoconductor fiber 705 from the top of the giver arm 7300 allows the deflection plate 7500 to move the return arm 7301 on both sides of the giver arm 7300 from their default (down) position to the "return" position (up) in which they will operate on the return of the transfer device 704. The deflection plate 7500 is a spring loaded plate connected to the return arm 7301 on each side of the giver arm 7300, which moves the arms up into the return position after the transfer device 704 moves past the return arm 7301 default position. In this embodiment, the deflection plate 7500 and return arm 7301 will be returned to the default (down) position after transfer of the nanoconductor fiber 705 across the shed and return of the transfer device 704 to its default position on the giver side of the loom.

FIG. 7K shows the operation of the dual rapier arm embodiment at the point in time when the taker arm 7400 returns the transfer device 704 back to the giver arm 7300. At this time, the nanoconductor fiber has been inserted across the width of the shed and automatically cut from the transfer device 704 when the taker arm started to return to the center of the loom. The capture arm 7403 has released the projecting pin 7103 on the taker arm side of the transfer device 704. On the giver arm 7300, the return arm 7301 on both sides of the giver arm 7300 have been placed in their return position (up) and attach to the projecting pin 7103 on the giver side of the transfer device 704 in order to transfer the transfer device 704 back to the giver arm 7300. The transfer device 704 and giver arm 7300 travel in this position back to the giver side of the loom, where the transfer device 704 and return arm 7301 on each side of the giver arm 7300 can be reset to their default position. Manual or automated means to return the giver arm 7300, return arms 7301 and transfer device 704 to their default position which are obvious to a person skilled in the art are intended to be covered by the current invention.

FIG. 7L shows an actuator mechanism which is used in the alternative embodiment based on dual rapier arm looms. This actuator will translate the position of the return arm 7301 of the giver arm 7300 to a linear force which actuates the release of the capture arm 7403 of the taker arm 7400. Conversion of the rotational motion of the giver's return arm 7301 is translated to linear motion by a rack 7600 and pinion 7601 mechanism, which applies linear force on an actuator shaft 7602 when the spring action of the deflection plate of the giver arm 7300 moves the giver's return arm 7301 to its return (up) position. The translated actuator shaft 7602 is in an extended position when the taker capture arm 7403 returns with the taker arm 7400. An actuator lever 7603 is attached to the taker arm 7400 such that the extended actuator shaft 7602 of the giver arm 7300 can move the actuator lever when the rapier arms meet. The movement of the actuator lever 7603 operates on the capture arm 7403 on the side of the taker arm 7400 and causes the capture arm 7403 to move up and release the transfer device 704 so that the return arm 7301 can attach to the projecting pin 7103 of the transfer device 704 and return the transfer device 704 to the giver arm 7300.

The apparatus embodiments presented in FIG. 7A through FIG. 7L support embodiments of the invention which cover the extent of a user's garment, with the nanoconductor fibers of the invention fully integrated in the length of the garment. An alternative embodiment of the invention comprises a smaller area of the garment in which the nanoconductor fibers and smart application of the invention is fully integrated with only one area of the garment. In this case, the nanoconductor fibers of the invention can be integrated with the garment through darning as one emodiment of the alternative application. FIG. 8 shows an example of how the invention's nanocondurctor fibers and electronic application can be integrated with the fabric by darning. In this embodiment, 801 is the area of the garment which has been opened for integration of the invention's nanoconductor fibers and supporting material. 802 are two or more nanoconductor fibers which have been integrated in this area as part of the darn. The 803 supporting material are other fibers, such as poly-cotton blend, which are darned into the same area as the invention's nanoconductor fibers. Other darning methods for fully integrating the invention's nanoconductor fibers and smart applications into a region of a cloth which are obvious to a person skilled in the art are intended to be covered by the current invention.

Yet another alternative embodiment of the invention which uses a different method to fully integrate the nanoconductor fibers and technology of the invention within the weave of the user's garment is a single pull needle approach. FIG. 9 shows and example of how the invention's nanoconductor fibers and technology can be pulled through a portion of the garment using a needle and by manually weaving the needle between the weave of the garment. 901 represents the area of the garment into which the invention is integrated. 902 is a nanoconductor fiber of the invention which has already been integrated with the garment. 903 shows a needle which is used to pull another nanoconductor fiber 904 through the weave of the garment. This example only shows two elements of the invention integrated in the user's garment, but other embodiments can include more nanoconductor fibers in various directions and orientations such that the invention creates a smart application based on the integrated nanocondcutor fibers and electronics. The number, orientation and arrangement of the invention's nanoconductor fibers and smart application based on this approach which are obvious to the person skilled in the art are intended to be covered by the current invention.

Embodiments of the invention which include various ways to fully integrate the nanoconductor fiber and tecnology of the invention with a wearable garment have been disclosed herein. Although some specific examples and designs for apparatus and other methods which can be used to fully integrate the invention with wearable apparel have been given, the intention of this invention is to cover all apparatus and means which can be used to integrate the invention into a wearable fabric or garment and which are obvious to anyone skilled in the art. Such other apparatus and means of integration of the invention into a wearable fabric or garment are within the scope of the invention and are intended to be covered by its claims.

FIG. 10 discloses how the geometry of the invention's nanoconductor fibers support novel ways to connect the nanoconductor fiber circuits in the garment with external conducting surfaces, leads or circuits. 1001 is a woven cloth portion of an article of clothing in which the invention's nanoconductor fibers 1002 and 1003 have been fully integrated with the weave of the cloth. In this drawing, the space between the weave is exaggerated to aid in discussion. In the embodiment shown in the example of FIG. 10, nanoconductor fiber 1002 is oriented so that the nanoconductor strip 602 of this fiber is facing up (not shown). The orientation of nanoconductor fiber 1003 is such that its nanoconductor strip 602 is facing down, as shown in the close-up view of FIG. 10. Connectors 1004 are depicted in FIG. 10 to show how the geometry of the nanoconductor fibers allow the conducting circuit of individual nanoconductor fibers 1002 and 1003 to make contact with a single connector depending on the orientation of each fiber. The connectors 1004 allow external circuits to connect to individual or multiple nanoconductor fibers of the invention through the leads 1005 shown in the figure. The novel connection feature of the invention shown in FIG. 10 demonstrates the preferred embodiment of how connections are made to the smart circuits comprising the integrated nanoconductor fibers of the invention because this method of connection does not require changes to the woven nanoconductor fibers after they are sewn into the garment. Other embodiment of connectors for the invention may require alternations or some changes to the weaving or orientation of the nanoconductor fibers in order to make contact with them.

FIG. 11 is an alternative embodiment for connecting the nanoconductor circuits of the invention to external conductors or circuits. In this example, the nanoconductor fiber 1101 wraps around the connector 1102, supporting a connection to an external device or circuit through a novel geometry which allows electrical contact similar to wrapped wires. The lead 1103 can be a soldered wire or other connection made to the connector from an external circuit. Other embodiments comprising connectors allowing connection to the invention's nanoconductor fibers and smart applications in addition to those disclosed in FIG. 10 and FIG. 11 which are obvious to a person skilled in the art are intended to be covered by the current invention.

In FIG. 12, different configurations of the nanoconductor fibers of the invention are shown with their electrical equivalents. 1201 is a nanoconductor fiber produced by a modified method of fabrication to that shown in FIG. 4 in which the size of the nanoconductor strip 602 is larger at a point in order to increase the resistance at that point. This higher resistance portion of the nanoconductor fiber is represented by a resistor 1202 in the circuit containing the modified nanoconductor fiber. Similarly, nanoconductor fiber 1203 is an example of how a capacitive element can be introduced into the smart circuits of the invention. The capacitor 1204 is how the nanoconductor fiber 1203 would be represented in a circuit representation of the invention's application.

The current invention comprises smart applications which can only be achieved using the novel geometry and integration of the nanoconductor fibers with the fabric of the garment. One embodiment of the invention's smart applications is based on a configuration of multiple nanoconductor fibers within a region of a garment which provides power to smart components integrated with the wearable electronics of the invention. The "smartness" of these applications relates to the ability to tailor the invention's capabilities to the user's intended use of the integrated, nanoconductor circuit. In one embodiment, the invention allows the micro-miniature electronic components to be added as discrete components during integration with the garment in order to tailor the invention to support a specific application for the user. An alternative embodiment allows micro-miniature logic circuits to be integrated with the nanoconductor power runs such that the function of those devices can be reconfigured by the user for specific applications.

FIG. 13 is a schematic showing how the nanoconductor fibers which are integrated in the cloth can be used to define an electronic circuit with smart applications based on discrete micro-miniature electronic components. In the embodiment of FIG. 13, pairs of nanoconductor fibers 1301 can be woven in parallel to distribute power along the length of the wearable electronic circuit. If a small positive voltage is applied to one of these nanoconductor fibers 1301 and the other conductor is grounded or pulled negative, the more positive voltage serves as VDD for an electrical circuit of micro-miniature components, which comprise one or more smart applications. In one embodiment, the more negative voltage is set to ground or 0 volts, but others can apply a non-zero voltage to the more negative nanoconductor as long as it is more negative than the VDD nanoconductor. Between the pair of nanoconductor fibers 1301, discrete micro-miniature components can be added to create applications which are tailored for different uses by the user. FIG. 13 shows one embodiment where a smart application for individual medical monitoring is made up of a temperature sensor 1302, operational amplifier (hereinafter "op amp") 1303 and a signaling LED 1304. Each of these components is attached to the VDD and ground runs for power. FIG. 13 also shows how voltage dividers can be configured between the VDD and ground runs and the resulting voltage is applied to the input of the op amp 1303 in this embodiment. Also shown in FIG. 13 are additional discrete components which support additional functions as part of the invention that is integrated with the garment. In this embodiment, a micro-miniature capacitive sensor button 1305 and capacitive sense module 1306 (hereinafter "capsense button"), an electronic timer circuit 1307, and LED 1308 is shown as a second group of discrete components which create a smart application tailored to a specific application of the user. These discrete components can be designed to display an alert signal that provides a blinking light to observers when the user presses the capsense button. Other examples of micro-miniature circuits that can be supported by the design of the invention shown in FIG. 13 which are obvious to a person skilled in the art are covered by the current invention as additional smart applications which can be used with the invention. The applications shown in FIG. 13 are examples of the most rudimentary smart application of the invention. In this embodiment, discrete micro-miniature components can be added to the nanoconductor circuit of FIG. 13 to tailor the invention to specific uses of the garment at the time that the invention is integrated into the garment. This embodiment also covers the removal or replacement of discrete components after the integration of the invention to allow other uses of the garment.

An alternative embodiment creates smart applications in the current invention based on the 2 power rail design shown in FIG. 13, but using logic components which can be integrated in the garment and reconfigured later to support different applications and uses. FIG. 14A shows an example of this alternative embodiment of the invention's smart applications. As in FIG. 13, FIG. 14A shows a VDD nanoconductor fiber rail 1401 and VSS nanoconductor fiber rail 1402. Between the power rails are discrete logic components which are connected to other loads within the circuit. In this embodiment, a number of components are grouped between the power rails for the purpose of performing a specific application for the user. One group shown in FIG. 14A is an example designed for a personal monitoring application. This group comprises a configuration input component 1403, a temperature sensor 1404 and op amp 1405, and an LED output 1406. The configuration input component 1403 is one of various components which can enable or disable the other components within the group. For example, FIG. 14B shows one such configuration input component 1403 in this embodiment, which is comprised of a capsense button 1407 a capacitive sensor module 1408, and a logic component 1409, which disables or enables the signals from the other components if the button is pressed. The configuration input component 1403, is connected to the VDD nanoconductor fiber rail 1401 and VSS nanoconductor fiber rail 1402 for power as shown in FIG. 14A. With this type of configuration input component 1403, the capsense button 1407 can be pressed by a clinical technician in order to enable the other components and provide a temperature sensor function in this part of the garment. Similarly, the capsense button 1407 of the configuration input component 1403 can be pressed a second time in order to disable the other components in the group and prevent temperature sensing in this part of the garment. When temperature sensing is enabled, the smart application of this embodiment of the invention will light the LED output 1406 when the wearer's temperature exceeds a threshold established at the input of the op amp 1405.

FIG. 14A includes an example of a second group comprising a second configuration input component 1410, a humidity sensor 1411 and op amp 1412 used to detect perspiration, and a second LED output 1413. As in the case of the first group of this embodiment, the configuration input component 1410 is comprised of the same components of FIG. 14B and can be used by the clinical techinician to disable or enable the perspiration sensing function. When enabled, this embodiment of the invention allows the sensing of perspiration near the cloth in which it is integrated and lights the LED output 1413 to alert the nurse or technician when the sensor is above a pre-determined threshold. By adding a number of similar groups of configurable components at the time of fabrication, the application of the invention can be tailored to the specific use of the user after fabrication by making appropriate inputs into selected parts of the invention's configuration inputs. By allowing configuration and re-configuration of the circuits which are integrated with the invention, the embodiment shown in FIG. 14A provides a "smarter" application than that shown in FIG. 13, which has to be configured at time of fabrication and cannot be reconfigured later in life like the smart application in FIG. 14A. This embodiment of the invention discloses a smart application approach for use of the invention which includes any number and type of configurable components that are obvious to a person skilled in the art, all such combinations and types being intended to be covered by the current invention.

Another embodiment of the invention's smart applications, which is the preferred embodiment, is based on a lattice 1500 of nanoconductor fibers that have been integrated with a garment and programmable components which are integrated in the lattice 1500. FIG. 15A shows an example of the preferred embodiment, where programmable nodes are distributed over the region of the nanoconductor fiber lattice 1500. The lattice 1500 would be connected to a configuration master 1501 which drives the configuration of the nodes in the lattice 1500. The configuration master 1501 can be a user input device or a processor which receives configuration inputs through another interface. In the preferred embodiment, the configuration master 1501 is a processor which provides a RS-485 master function and is connected to all of the nodes through a separate pair of nanoconductor fibers comprising an RS-485 bus 1502. The RS-485 bus 1502 of this embodiment is not shown in FIG. 15A. In this embodiment, each node would comprise one or more components that are connected to the other nodes by the nanoconductor fiber lattice 1500 and which support a particular function. FIG. 15B is a close-up view of a node in this lattice 1500, which shows the RS-485 bus 1502, a communication component 1503, a configurable logic component 1504, an active component 1505, and an output component 1506. The logic component 1504 supports logic states which enable or disable the other components of that node. The purpose of the communication component 1503 is to receive inputs from the configuration master 1501, which in the preferred embodiment, is a serial input from the RS-485 master, communicated over the RS-485 bus 1502. The communication component 1503 will drive the logic component 1504 to a true or false condition based on the serial input from the configuration master 1501. In the preferred embodiment, the node's communication component 1503 will act as an RS-485 slave device and will toggle the state of the logic component 1504 when the configuration master 1501 sends a command to the slave. Although the preferred embodiment discloses communication between the configuration master 1501 and communication components 1503 at the nodes of the lattice 1500 using serial communications based on RS-485, other communications methods are possible in alternative embodiments. For example, a serial communications circuit which allows addressing of the communication components 1503 at the nodes of the lattice 1500 similar to how boundary scan testing is performed with JTAG interfaces can be used to connect to and configure the configurable logic component 1504 of an alternative embodiment. Any similar communications connection and protocol which supports communications between the configuration master 1501 and the communication components 1503 at the nodes of the lattice 1500 and are obvious to a person skilled in the art is intended to be covered by the current invention.

In the preferred embodiment, the RS-485 connection between the configuration master 1501 and nodes of the lattice 1500 allow for the smart application of the invention to be programmed by configuration signals to individual nodes. The communication component 1503 of each node is connected to two nanoconductor fibers that provide the RS-485 bus 1502 as shown in FIG. 15C. The lattice of nanoconductor fibers 1500 which provides a power connection to each node is not shown in FIG. 15C. The RS-485 configuration master 1501 addresses each node individually using a serial protocol such as Modbus over the RS-485 bus 1502. Repeater nodes 1507 are placed at the end of rows of the lattice 1500 so that the serial signal from the configuration master 1501 can be transmitted to the next row. Termination resistors 1508 matched to the characteristic impedance of the signaling lines, which are based on nanoconductor fibers fabricated with resistance as shown in FIG. 12, can be used to reduce reflections in the serial network created by the RS-485 bus 1502. In the preferred embodiment which uses this design, the configuration of the individual nodes can be "programmed" to enable active nodes and disable nodes, in order to achieve a smart application of the invention tailored for the intended use.

In FIG. 15B, the active component 1505 of each node is enabled or disabled by the logic signal of the node's logic component 1504. The purpose of the active node 1505 is to provide an application specific function to the point in the garment located at the node. An example of an active component 1505 is a temperature sensor which provides a signal to the output component 1506. The output component can be an LED output, which is used as an alert signal, or an analog-to-digital converter, which outputs a digital value for the temperature of the user's body at that node. A temperature sensor outputting to an LED is the preferred embodiment, but other types and combination of active components 1505 and output components 1506 which are obvious to a person skilled in the art are intended to be covered by other embodiments of the invention. In the preferred embodiment of the invention, the active component 1505 is the same at each node of the lattice 1500. In this case, the smart application of the invention supports the user re-configuration of the number and location of active components 1505 which are enabled. For example, if one side or region of the lattice 1500 is of interest to the user's application, the user can set the configuration of the active components 1505 to enable the nodes in the area of interest. In other embodiments, the active component 1505 can vary between the nodes of the lattice 1500 and can include a number of devices which support various functions. The smart application in these embodiments will allow an individual garment to be used for a specific user's application and another garment of the same design to be configured for a different use.

An alternative embodiment of the invention's smart applications is shown in FIG. 16A, where capsense buttons 1601 are used as the active component of the invention's lattice 1602. The drawing of FIG. 16A is not a detailed schematic and only shows a single line connection between nodes and devices, such lines representing two or more nanoconductor fibers for power or serial communication circuits as required by the connected device. In this embodiment, the user can enable different regions of the garment to use the capsense buttons in those areas as user input. An output component 1603 which outputs the values of the buttons pressed to a user interface device 1604 would allow those regions of the invention's lattice which are enabled to serve as keypad input devices. Two examples of active keypad inputs in this embodiment are shown in FIG. 16B and FIG. 16C. In FIG. 16B, the capsense buttons 1601 are placed in a typical arrangement for a keypad 1605. In this case, a single button is pressed at a time to enter a single, fixed value. The alternative example in FIG. 16C shows how a number of capsense buttons 1601 can create a drawing surface 1606, allowing the use of a finger or capacitive stylus 1607 to draw a character for input. In this example, the character is drawn by a finger and the path traced by the finger is shown as highlighted in the view. The highlighted character in this example is for illustration only as the invention is not expected to change the color or lighting of the drawing surface 1606. This embodiment would support alphanumberic characters as well as different glyphs for multiple languages. Other arrangements of capsense buttons 1601 as part of a drawing surface 1606 in varying width, height, order or shape for the purpose of capturing user input of alphanumeric characters or other input which is obvious to a person skilled in the art is intended to be covered by this invention. The embodiment is an example of a lattice 1602, which provides smart applications based on nodes of the same type.

Another alternative embodiment of the invention is based on a lattice with nodes supporting different functions. FIG. 17A shows a smart application of the invention which provides for command of a Unmanned Air Vehicle, UAV 1701, from a ground operator 1702. FIG. 17B shows a close-up of the garment worn on the arm of the operator 1702 which contains a lattice comprising active components 1703 based on accelerometers sensing horizontal direction movement (parallel to the ground) and output components 1704 with LEDs. Other active components within the lattice which are not configured as enabled by the invention are not shown. The purpose of this smart application is to allow the ground operator 1702 to control the UAV 1701 through arm gestures and light signals from the LEDs. In this embodiment, the outputs of the accelerometer active components 1703 drive the outputs of the LED output components 1704 so that when the ground operator 1702 moves his arms in the horizontal direction, the light is emitted by a pattern of LED output components 1704 as shown in FIG. 17B. In this embodiment, the LED output components 1704 are infrared LEDs which are visible to the UAV 1701 by use of an infrared sensor and which would not be visible to an observer who is not equipped to view such signals. In the view of FIG. 17C, the same embodiment of the invention is shown, where accelerometer active components 1705 which sense a different arm motion in the z-direction (up and down motion) are used at different nodes to drive the LED output components 1704 at those nodes and provide a different light pattern to the UAV 1701, for a different arm gesture. This is an example of the embodiment of the invention's smart applications based on having nodes of different types. The type of output signal and pattern shown in FIG. 17B and FIG. 17C are for one embodiment and other types of output components, signals, patterns, arrangements and number which can be integrated with the clothing as part of this invention and are obvious to a person skilled in the art are intended to be covered by the invention.

The foregoing disclosure has described the current invention in considerable detail, including a preferred embodiment or embodiments. Notwithstanding this fact, other embodiments of the current invention are possible. Therefore, the spirit and scope of the accompanying claims should not be limited to the preferred or other embodiments disclosed herein. Unless the accompanying claims explicitly contain the phrases "means for" or "step for", the provisions of 35 USC § 112(f) are not intended and 35 USC § 112(f) should not be applied to interpret the claim's limitations. All features described in this specification and its accompanying claims, abstract, and drawings may be replaced by an alternative feature which serves the same purpose or a similar purpose, unless explicitly stated otherwise.

What is claimed:

1. A wearable nanoconductor device comprising:

an article of clothing;

one or more fibers of substrate material having circular cross-section which are secured to the article of clothing as an integral part of the clothing;

a nanoconductor polymer mat structure secured along one or more of said fibers with a nano-scale width which is less than the cross-section size of a common textile thread, such cross-section size having a range of 150 micrometers to 9,000 micrometers;

such nanoconductor structure having a fixed geometry with respect to said fiber which defines a configuration, such configuration comprising at least one of the following:

a configuration in which the nanoconductor stricture is restricted to one hemisphere of the fiber's cross-section;

a configuration in which the nanoconductor structure runs between both hemispheres of the fiber's cross-section;

a configuration in which the fixed geometry of the nanoconductor structure allows an electrical connection to one side of a lead of an external circuit which is attached to the article of clothing.

2. The device of claim 1 wherein the fiber substrate material is a polyester.

3. The device of claim 1 wherein the nanoconductor structure is made of polyacrylnitrile (PAN).

4. The device of claim 1 wherein the nanoconductor structure is metalized with conductive material.

5. The device of claim 4 wherein the conductive material is silver.

6. The device of claim 4 wherein the conductive material is gold.

7. The device of claim 4 wherein the conductive material is nickel.

8. The device of claim 1 wherein the nanoconductor structure secured along the fiber substrate has a nano-scale width less than 600 nanometers.

9. The device of claim 1 wherein the nanoconductor structure is formed from a deposition of a polymer stream by electrospinning.

10. The device of claim 1 wherein each fiber of substrate material and nanoconductor structure forms a nanoconductor fiber, with at least two of such nanoconductor fibers being connected to form at least one electronic circuit integrated with the article of clothing and having connections to a power source which supplies power to said circuit.

11. The device of claim 10 wherein the electronic circuit connected to the nanoconductor fiber is comprising discrete components.

12. The device of claim 10 wherein the electronic circuit connected to the nanoconductor fiber is comprising one or more discrete components made of nanoconductor structure formed with different widths and spacings to form equivalent discrete components.

13. The device of claim 10 wherein the electronic circuit connected to the nanoconductor fibers is comprising one or more configurable logic circuits.

14. The device of claim 10 wherein the electronic circuit connected to the nanoconductor fibers is comprising a lattice with configurable logic circuits at one or more nodes of the lattice.

15. The device of claim 10 wherein the elements of the circuit comprising the nanoconductor fibers are programmable.

16. The device of claim 15 wherein the elements can be activated or disabled through programming.

17. The device of claim 15 wherein the configuration or function of the elements can be changed through programming.

18. The device of claim 13 wherein the configurable logic circuits comprise one or more capsense input devices which can be enabled and disabled.

19. The device of claim 18 wherein the capsense nodes form a keypad.

20. The device of claim 18 wherein the capsense nodes form a drawing surface.

21. The device of claim 13 wherein the configurable logic circuits comprise one or more light signaling devices.

22. The device of claim 13 wherein the configurable logic circuits comprise one or more motion sensing devices.

23. The device of claim 13 wherein the configurable logic circuits comprise one or more light signaling devices and one or more motion sensing devices, which the user can move with the fabric to change the light signaling devices and communicate with other parties.

24. The device of claim 1 wherein a portion of the article of clothing can be removed from the other part of the original article of clothing so that the electronic circuit made of the nanoconductor fibers can be used on another article of clothing or be used separate from the original article of clothing.

25. The device of claim 1 wherein the nanoconductor structure secured along the fiber substrate has a width less than 150 micrometers.

26. The device of claim 1 wherein fibers of substrate material secured to the article of clothing have an eliptical cross-section.

27. The device of claim 1 wherein fibers of substrate material secured to the article of clothing have a non-circular cross-section with a curved external surface.

28. A wearable nanoconductor device comprising:

an article of clothing;

one or more fiber substrates having circular cross-section which are secured to the article of clothing as an integral part of the article of clothing;

a nanoconductor structure secured along at least one of the fiber substrates, such nanoconductor structure having a width less than 150 micrometers;

wherein the nanoconductor structure is formed out of nano-scale polymer mats comprising a deposition of a polymer stream produced by means of electrospinning;

wherein the nanoconductor structure is metalized with conductive material;

such nanoconductor structure having a fixed geometry with the fiber substrate which defines a configuration, such configuration comprising at least one of the following:

a configuration in which the nanoconductor structure is restricted to one hemisphere of the fiber's cross-section;

a configuration in which the nanoconductor structure runs between both hemispheres of the fiber's cross-section;

a configuration in which the fixed geometry of the nanoconductor structure allows an electrical connection to one side of a lead of an external circuit which is attached to the article of clothing.

29. A wearable nanoconductor device comprising:

an article of clothing;

one or more fiber substrates having circular cross-section which are secured to the article of clothing as an integral part of the article of clothing;

a nanoconductor structure secured along each of the fiber substrates which are nanoconductor fibers, such structure having a width less than 150 micrometers;

a circuit made up of the nanoconductor fibers, such circuit comprising a circuit of one or more discrete electronic components and any number of connectors to mate with the nanoconductor structure of the circuit's nanoconductor fibers using a fixed geometry of the nanoconductor structure and fiber substrate, such connectors to allow connection between a power source, the nanoconductor fibers or circuit devices, or to allow connection between the circuit and external circuits, devices, or power sources;

wherein the discrete electronic component or components are comprising:

one or more discrete components that are made of nanoconductor structure formed with different widths and spacings to form equivalent discrete components;

one or more discrete components not made of the nanoconductor structure;

wherein the nanoconductor structure is formed out of nano-scale polymer mats comprising a deposition of a polymer stream produced by means of electrospinning;

wherein the nanoconductor structure is metalized with conductive material;

such nanoconductor structure having a fixed geometry with the fiber substrate which defines a configuration, such configuration comprising at least one of the following:

a configuration in which the nanoconductor structure is restricted to one hemisphere of the fiber's cross-section;

a configuration in which the nanoconductor structure runs between both hemispheres of the fiber's cross-section;

a configuration in which the fixed geometry of the nanoconductor structure allows an electrical connection to one side of a lead of an external circuit, device or power source.

30. A wearable nanoconductor device comprising:

an article of clothing;

one or more fiber substrates having circular cross-section which are secured to the article of clothing as an integral part of the article of clothing;

a nanoconductor polymer mat structure secured along each of the fiber substrates which are nanoconductor fibers, such structure having a width less than 150 micrometers;

a circuit made up of the nanoconductor fibers, such circuit comprising at least one of the following:

a circuit of one or more logical components;

a circuit of one or more configurable components;

a circuit of one or more programmable components;

one or more connectors to mate with the nanoconductor structure of the circuit's nanoconductor fibers using a fixed geometry of the nanoconductor structure and fiber substrate, such connectors to allow connection between the power source, nanoconductor fibers or circuit devices, or to allow connection between the circuit and external circuits, devices, or power sources;

a power supply consisting of one or more of the following:

one or more power sources integrated with the article of clothing;

one or more connectors such connectors connectable to an external power source;

such nanoconductor structure having a fixed geometry with the fiber substrate which defines a configuration, such configuration comprising at least one of the following:

a configuration in which the nanoconductor structure is restricted to one hemisphere of the fiber's cross-section;

a configuration in which the nanoconductor structure runs between both hemispheres of the fiber's cross-section;

a configuration in which the fixed geometry of the nanoconductor structure allows an electrical connection to one side of a lead of an external circuit, device or power source.

31. A wearable nanoconductor device comprising:

an article of clothing;

one or more fiber substrates having circular cross-section which are secured to the article of clothing as an integral part of the article of clothing;

nanoconductor polymer mat structure secured along each of the fiber substrates which are nanoconductor fibers, such structure having a width less than 150 micrometers;

a circuit of said nanoconductor fibers and made up of components or devices which are designed to function as smart components or devices comprising at least one of the following:

one or more components or devices which can be configured prior to or at the time of donning to select or perform different functions;

one or more components or devices which can be configured during wear to select or perform different functions;

one or more components or devices which can be programmed prior to or at the time of donning to select or perform different functions;

one or more components or devices which can be programmed during wear to select or perform different functions;

one or more components or devices which can be configured or programmed by the circuit;

a power supply consisting of one or more of the following:

one or more power sources integrated with the article of clothing;

one or more connectors to mate with the nanoconductor structure of the circuit's nanoconductor fibers using a fixed geometry of the nanoconductor structure and fiber substrate, such connectors connectable to an external power source.

32. A method of making the wearable nanoconductor device of claim 1, such method comprising:

electrospinning a polymer mat;

attaching the polymer mat onto a polymer substrate using deposition with a mask of a width of 150 micrometers or less;

metalizing the deposited polymer mat to form a nanoconductor structure, whereby the nanoconductor structure and polymer substrate form a nanoconductor fiber;

integrating the nanoconductor fiber with other fibers within a weave or stitch of an article of clothing, whereby the nanoconductor structure on the polymer substrate has a fixed orientation to the surface of the article of clothing.

33. A method of making the wearable nanoconductor device of claim 1, such method comprising:

electrospinning a polymer mat;

depositing the polymer mat onto a planar surface;

metalizing the polymer mat to form a nanoconductor structure;

cutting the nanoconductor structure to a width of 150 micrometers or less;

attaching the nanoconductor structure on a polymer substrate using deposition to form a nanoconductor fiber;

integrating the nanoconductor fiber with other fibers within a weave or stitch of an article of clothing, whereby the nanoconductor structure on the polymer substrate has a fixed orientation to the surface of the article of clothing.

* * * * *